US006464415B1

(12) United States Patent
Vaghi

(10) Patent No.: US 6,464,415 B1
(45) Date of Patent: Oct. 15, 2002

(54) PERSONAL COMPUTER HAVING A BUILT-IN PRINTER, AND A SYSTEM AND METHOD FOR COMPUTING RATE INFORMATION USING THE COMPUTER

(75) Inventor: Nino Vaghi, McLean, VA (US)

(73) Assignee: Vaghi Family Intellectual Properties, LLC, McLean, VA (US)

( * ) Notice: Subject to any disclaimer, the term of this patent is extended or adjusted under 35 U.S.C. 154(b) by 0 days.

(21) Appl. No.: 09/883,994

(22) Filed: Jun. 20, 2001

Related U.S. Application Data

(62) Division of application No. 09/665,762, filed on Sep. 20, 2000, now Pat. No. 6,315,470.

(51) Int. Cl.[7] ..... B41J 3/39
(52) U.S. Cl. ..... 400/88; 400/103; 400/104
(58) Field of Search ..... 400/88, 103, 104

(56) References Cited

U.S. PATENT DOCUMENTS

| | | | | |
|---|---|---|---|---|
| 3,591,221 A | | 7/1971 | Alley | |
| 4,120,371 A | | 10/1978 | Zohn et al. | |
| 4,139,892 A | | 2/1979 | Gudea et al. | |
| 4,456,085 A | | 6/1984 | Boyles | |
| 4,582,151 A | | 4/1986 | Mairot et al. | |
| 4,586,575 A | | 5/1986 | Muerdter et al. | |
| 4,597,457 A | | 7/1986 | Ikekita | |
| 4,638,439 A | | 1/1987 | Daniels | |
| 4,700,656 A | | 10/1987 | Cone et al. | |
| 4,726,435 A | | 2/1988 | Kitagawa et al. | |
| 4,754,653 A | | 7/1988 | Hafner et al. | |
| 4,778,017 A | | 10/1988 | Liang | |
| 4,799,559 A | | 1/1989 | Murdter et al. | |
| 4,814,995 A | | 3/1989 | Daniels, Jr. | |
| D302,798 S | | 8/1989 | Wolff, Jr. | |
| 4,880,069 A | | 11/1989 | Bradley | |
| D305,103 S | | 12/1989 | Kennedy | |
| 5,139,100 A | | 8/1992 | Brauneis | |
| D329,227 S | | 9/1992 | Kurth et al. | |
| 5,188,464 A | * | 2/1993 | Aaron | 235/462.01 |
| 5,257,197 A | * | 10/1993 | Gunther et al. | 364/464.02 |
| 5,307,281 A | | 4/1994 | Wollman | |
| 5,438,496 A | | 8/1995 | Meur et al. | |
| 5,443,320 A | | 8/1995 | Agata et al. | |
| 5,496,972 A | | 3/1996 | Demar et al. | |
| 5,521,596 A | | 5/1996 | Selker et al. | |
| 5,559,932 A | | 9/1996 | Machida et al. | |
| 5,606,507 A | | 2/1997 | Kara | |

(List continued on next page.)

OTHER PUBLICATIONS

Internet.com, "Notebook Computer" pub . date unknown, web page from http://isp.webopedia.com.

Internet, "Personal Computer" pub . date unknown, web page from http://isp.webopedia.com.

*Primary Examiner*—Andrew H. Hirshfeld
*Assistant Examiner*—Charles H. Nolan, Jr.
(74) *Attorney, Agent, or Firm*—Fleshner & Kim, LLP

(57) ABSTRACT

A personal computer includes a built-in printer having a transport path which extends parallel to a surface of the computer housing. The transport path may extend along the entire length of the housing surface, or only partially so. Situated within the housing is a printhead which may be either fixed or movable relative to a print medium inserted into the transport path. If movable, the printhead may have one or two degrees of freedom. An arrangement of sensors, rollers, and other mechanisms may be situated into the housing to automatically move a print medium through the transport path. The personal computer may be incorporated within a system for printing a mark indicative of a stamp or private-carrier rate on an envelope inserted into the transport path. In this system, the scale may be weighed using a removable scale cartridge inserted into a communications port of the computer.

20 Claims, 21 Drawing Sheets

U.S. PATENT DOCUMENTS 5,615,120 A 3/1997 Schwartz et al.
5,724,245 A 3/1998 Maher et al.
5,752,049 A 5/1998 Lee
5,773,767 A 6/1998 Collins Jr. et al.
5,845,144 A 12/1998 Tateyama et al. ..... 395/800.01
5,933,166 A 8/1999 Andrews et al.
5,953,712 A * 9/1999 Herbert ..... 705/401
5,980,010 A 11/1999 Stephenson
6,013,878 A 1/2000 Schwartz et al.
6,037,548 A 3/2000 Baitz et al.
6,064,991 A 5/2000 Reisinger et al.
6,158,906 A 12/2000 Simon et al. ..... 400/88
6,194,671 B1 * 2/2001 Vaghi ..... 177/25.15
6,208,980 B1 * 3/2001 Kara ..... 705/408
6,249,778 B1 6/2001 Vaghi

* cited by examiner

PERSONAL COMPUTER HAVING A BUILT-IN PRINTER, AND A SYSTEM AND METHOD FOR COMPUTING RATE INFORMATION USING THE COMPUTER

This application is a divisional of U.S. patent application Ser. No. 09/665,762, filed on Sep. 20, 2000 now U.S. Pat. No. 6,315,470. The contents of which are incorporated herein by reference.

BACKGROUND OF THE INVENTION

1. Field of the Invention

This invention generally relates to computer systems, and more particularly to a personal computer equipped with a built-in printer and a system and method for using that computer to print information on items of various sizes.

2. Description of the Related Art

Over that past several decades, the personal computer has proven to be an indispensable tool for performing a variety of personal and business applications. Through the personal computer, for example, offices now enjoy automated accounting and word processing capabilities, archive large amounts of data, and perform inventory analysis with pin-point accuracy. On a more personal level, the personal computer allows users to access the internet, keep track of personal finances, and play video games. In short, the personal computer has become ubiquitous in everyday life, making its absence inconceivable for all practical purposes.

Most recently, notebooks have emerged as the preferred form of the personal computer. These "portable" computers are advantageous because they integrate the traditionally separate features of a desktop computer (e.g., CPU, display, and keyboard) into a single, easy-to-carry unit. One drawback of this type of computer, however, is that it is not yet fully integrated in terms of the hardware needed to function as a portable office. For example, while a disk drive, keyboard, and display are standard features on a notebook, a printer is not. Notebook users, and especially those on travel, are therefore forced to take alternative and often time-consuming steps to print the documents they need. These steps most typically include searching for a surrogate office equipped with a printer, e-mailing documents to secretaries for remote printing, or simply waiting until a printer conveniently becomes available. This is particularly troublesome to persons who require hard copies of their work on an immediate basis. See, for example, the article "Get Up and Go" in *Fortune: Technology Guide,* Summer 2000 issue.

Second generation notebook computers have been designed with a built-in printer. One such notebook, disclosed in U.S. Pat. No. 5,443,320 to Agata, is equipped with a paper transport path which passes underneath the entire length of a removable keyboard. Designing the transport path in this manner makes the Agata notebook undesirable for a number of reasons.

First, integrating the transport path into the Agata computer requires substantial re-alignment of the internal electronics of the notebook. The disk drive and processing circuits, for example, must be moved to non-standard positions in order to accommodate the internal battery, printhead, feed rollers and other components of the printer. This makes the Agata notebook expensive to manufacture, which translates into increased cost for the user. Re-alignment of components also increases the overall thickness and weight of the notebook, as specialized mounting plates are required to support the platen, printhead, and other printer components.

Second, integrating the transport path under the keyboard consumes virtually all the internal space of the Agata notebook. This severely limits the capaability of the notebook to be upgraded with add-on or peripheral devices such as additional disk drives, PCMCIA cards, and other features which have proven to be desirable to many users, especially those in business.

Third, forming the transport path under the keyboard makes the processing circuits of the Agata computer hard to reach by technicians, which contributes to the cost and complexity of maintaining the notebook.

Fourth, the Agata patent makes clear that before printing, a user must remove the keyboard to adjust an internal paper guide to match the paper being printed on. This removal step is especially necessary in the case of envelopes and other odd-sized print items. Having to remove the keyboard adds process steps needed for printing, makes the notebook inconvenient to use, and increases its susceptibility to wear and damage.

A need therefore exists for personal computer having a built-in printer which represents an improvement over Agata-type notebooks in terms of convenience, cost, versatility, and efficiency to the user.

SUMMARY OF THE INVENTION

It is a first object of the present invention to provide a personal computer having a built-in printer which overcomes the drawbacks of conventional computers of this type.

It is another object of the present invention to achieve the first object by forming the transport path of the printer to be parallel to a peripheral edge of the computer housing, thereby minimizing or altogether eliminating the need to rearrange the internal electronics of the computer into non-standard positions. This results in a substantial reduction in costs both to the manufacturer and end user, as well as a minimization in any increase in the size of the computer housing that might be required in order to accommodate the printer.

It is another object of the present invention to provide a personal computer having a built-in printer, wherein the transport path of the printer is formed by a slot having a depth which only minimally extends into the internal portions of the computer housing, thereby minimizing the need to rearrange the internal electronics of the computer and thus allowing the computer to be upgraded with add-on or peripheral devices in virtually the same way as computers without built-in printers.

It is another object of the present invention to provide a personal computer with a built-in printer which has minimally invasive transport path which allows technicians to conveniently access the internal electronics of the computer for maintenance and other purposes.

It is another object of the present invention to provide a personal computer having a built-in printer which prints documents without requiring the removal of any components of the computer. This not only reduces the number of process steps required for printing, but also increases the useful life of the computer by minimizing the degree to which dust and debris enters the housing.

It is another object of the present invention to provide a personal computer having a built-in printer which prints information on envelopes and other odd-sized items without requiring a user to adjust any features of the transport path including paper guides, thereby simplifying the printing process along with its speed and efficiency.

It is another object of the present invention to provide a system and method which uses a personal computer of the aforementioned type to print information (e.g., private carrier and/or postage rate marks, address information, advertisements, postal bar codes) on items of mail, standard forms, and other types of print media, thereby enabling persons away from the home or office to mail work papers, personal correspondence, and other items on an immediate basis. This object is further enhanced by installing a rate-computing program on the computer which can print rates/postage of international countries as well as domestic, thereby enabling users to mail items without having to visit the post offices of foreign governments.

It is another object of the present invention to provide a system of the aforementioned type wherein the rate-computing program receives weight information from an electronic scale, and moreover one in the form of a removable scale cartridge inserted into a communications port of the computer.

It is another object of the present invention to provide an electronic device equipped with the built-in printer described above, where the electronic device includes at least one of a keyboard, central processing unit, printer, or display.

The foregoing and other objects of the invention are achieved by providing a personal computer which has a built-in printing device mounted adjacent a transport path that extends parallel to a surface of the computer housing. The transport path is formed by a slot having a predetermined depth which may be selected to define a predetermined printing range of the printer. This depth may define a maximum printing range. Alternatively, the maximum printing range may be delimited by adjustable stop members disposed within the slot. Additional stop members may be included for orienting a print medium into a print position when inserted into the slot.

According to a first embodiment, the transport path extends along an entire length of one side of the computer housing, opening along its corners to define an entrance and exit respectively. Preferably, the transport path is equipped sensors and rollers which automatically advance a print medium to a printing position within the slot when the medium is inserted into the entrance. After printing, the rollers conveniently discharge the printed medium from the transport path. According to another aspect of the invention, the transport path is configured to allow a user to slide the print medium through the slot by hand. The printing mechanism includes a printhead which may be fixed, movable in a transverse direction relative to the transport path, or movable in transverse and parallel directions relative to the transport path.

According to a second embodiment, the transport path define extends partially across a side surface of the computer housing, terminating at a side wall perpendicular to the slot. Preferably, the side wall functions as a stop to orient a print medium at a print position when inserted. The transport path of this embodiment may also be equipped with sensors and rollers for automatically moving a print medium within the slot, both before and after printing.

According to another embodiment, the transport path is formed in a direction perpendicular to the side of the housing into which the slot is formed. The path, however, has a predetermined depth which only minimally extends into the computer housing, and printing is performed in a manner similar to the second embodiment.

The system and method of the present invention uses the personal computer to print postage on mail including letters, envelopes, postcards, packages and other items. The computer is loaded with a rate-computing application program which computes private carrier rates and/or postage based on weight information derived from the scale. Preferably, the scale is an electronic scale connected to a communications port of the computer, in which case a weight signal indicative of the weight of the item of mail is automatically into the rate-computing program. An especially advantageous embodiment of the invention involves inserting a removable scale cartridge into a connector of the computer, e.g., a PCMCIA slot. This allows the computer of the invention to form a single, fully integrated unit for computing and printing stamps/carrier rate information on mail.

The method of the present invention is performed using the system described above. This method includes: integrating a printer into a housing of a personal computer; forming a slot along a surface of the housing at a position adjacent the printer; computing a postage or private carrier rate based on weight information indicative of a weight of the item of mail; inserting the item of mail into the slot forming the transport path of the printer; and printing a mark indicative of the postage or private carrier rate on the item of mail.

DETAILED DESCRIPTION OF THE INVENTION

For purposes of this description, the term "personal computer" includes a desktop computer, a portable computer such as a laptop or notebook, and hand-held computers including personal digital assistants and so-called pocket PCs, as well as internet web appliances.

Figure 1:
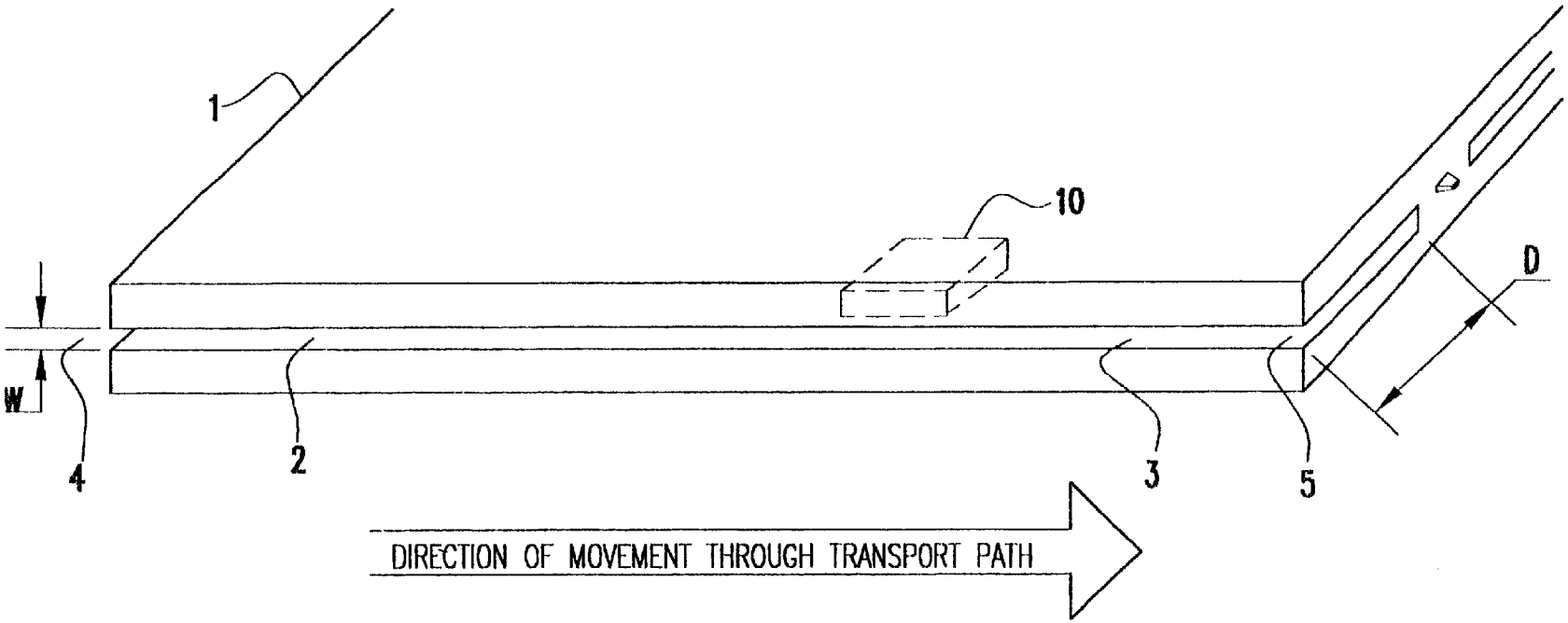
FIG. 1 is a diagram showing a first embodiment of the personal computer of the present invention.

Referring to FIG. 1, a first embodiment of the personal computer of the present invention includes a housing 1 having a slot 2. This slot defines a transport path 3 having an entrance 4 and an exit 5, both of which open along corners of the housing. The transport path, thus, extends in a direction parallel to a side of the computer housing and thus allows users to print items simply by sliding or inserting them along the housing peripheral edge. The housing may include one or more of a keyboard, central processing unit, and display as well as any number of built-in peripherals such as a CD-ROM and/or floppy drive. Also, the housing may include a computer card (e.g., PCMCIA) slot for receiving removable peripherals.

The dimensions of slot 2 may be selected to serve a number of functional purposes. For example, the slot may have a width "W" sufficient to accommodate a print medium (e.g., paper, cardboard, envelopes, address labels, adhesive postal labels) of various types and sizes. The depth "D" may be selected to define a predetermined printing range relative to a print medium inserted into the slot. This depth may, for example, correspond to the standard position of a stamp on an envelope. Alternatively, the depth may be selected to include a position for addressee information in addition to the stamp position. Those skilled in the art can appreciate that these positions are merely illustrative of the invention, as the depth of slot 2 may encompass printing positions to suit other forms of print media. For example, the slot may be selected to orient predetermined boxes on a standard form within a printing range.

Figure 2:
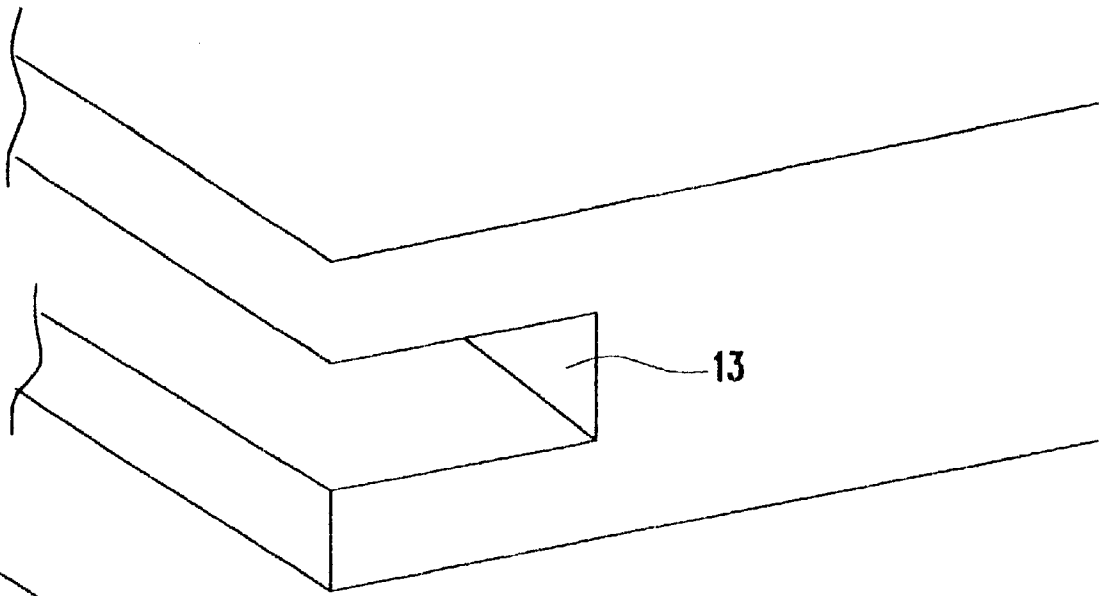
FIG. 2 is a diagram showing a manner in which the slot defining the transport path may be formed in accordance with the present invention.

In order to orient a print medium at a printing position, the slot may further include a back wall 13, as in FIG. 2, which abuts a side edge of a print medium to place it into alignment relative to a printing device incorporated within the slot. A back wall of this type is preferable as it will prevent dust and debris from entering internal portions of the computer.

Figure 3:
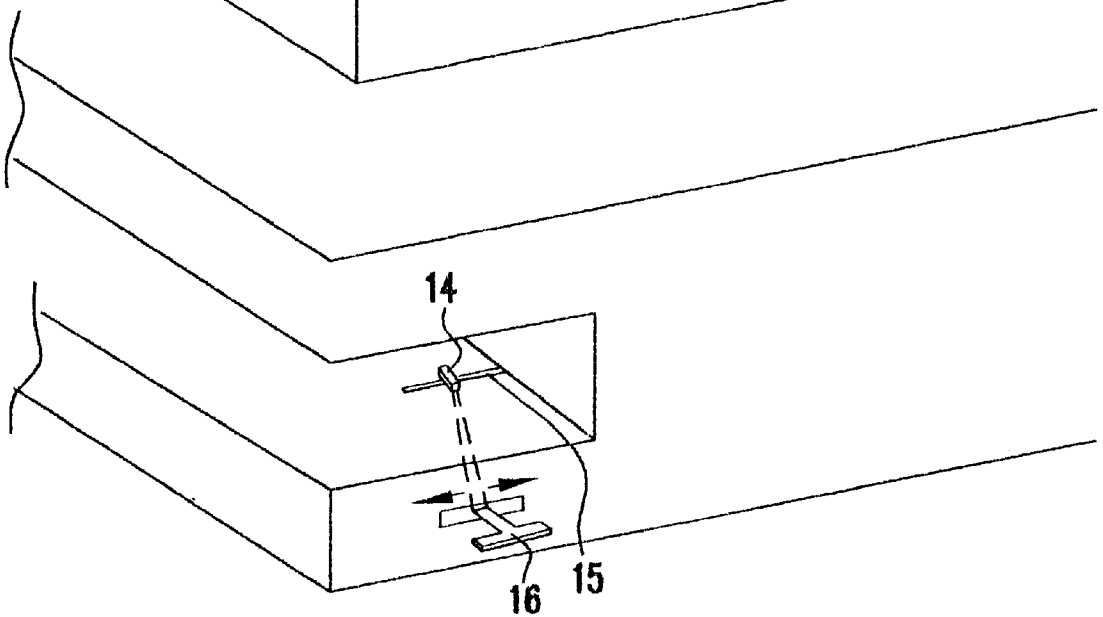
FIG. 3 is a diagram showing an adjustable stop member in accordance with the present invention for defining a depth of the slot forming the transport path, and for therefore adjusting the printing range of the printer of the invention relative to a print medium inserted into the slot.

Alternatively, the slot may be constructed with a completely or partially open back wall, in which case mechanical stop members may be mounted within the slot to define the slot depth. If desired, the mechanical stop members may be position-variable to allow a user to vary the printing range of the printer in order to match a print medium to be inserted. FIG. 3 illustratively shows one type of a stop member 14 which adjustably slides along a groove 15 formed in the slot when a user urges a handle member 16 back and forth. To provide the dual benefit of a variable printing range and dust protection, mechanical members may be combined with a back wall or partial back wall.

Returning to FIG. 1, situated within the housing at a position adjacent the slot is a printing device 10. This printing device is preferably mounted at a position towards the exit of the transport path in order to give a user sufficient clearance for inserting a print medium. Those skilled in the art can appreciate, however, that the printing device may be positioned at any position along the slot. Additionally, the printing device may be any conventional type with sufficient resolution to print text and/or graphics. Printers of this type include inkjet printers, laser printers, thermal printers, and dot-matrix printers.

An inkjet printhead of a size suitable for printing in accordance with the present invention is disclosed, for example, in U.S. Pat. No. 5,980,010. A thermal printhead of a size suitable for printing in accordance with the present invention may also be used, as well as a dot-matrix printer. A dot matrix printer of a size suitable for printing in accordance with the present invention is disclosed, for example, in U.S. Pat. No. 5,559,932. In each of the embodiments described herein, the printing device may be powered by the power supply of the personal computer, by its own battery, or both.

The printing device of the present invention may be fixed or movable. When fixed, as shown in FIG. 1, the printing device preferably includes a linear-array type printhead which having inkjet ports that extend the entire width of the printing range so as to facilitate one-pass printing. U.S. Pat. No. 5,933,166 discloses an inkjet printhead of this type.

When movable, the printing device may include a printhead which has one or two degrees of freedom. A printhead with one degree of freedom moves in transverse direction relative to the transport path while staying fixed in a parallel direction. A printhead with two degrees of freedom moves in transverse and parallel directions relative to the transport path. The housing of the computer may be extended, as needed, to accommodate the carriage assemblies, motors, slide rails, and control circuits required for automatically moving the printhead through the transport path formed in the slot. Any one of a variety of conventional printheads of the aforementioned type may be used. U.S. Pat. No. 5,980,010, for example, discloses a printhead having two degrees of freedom.

Figure 4:
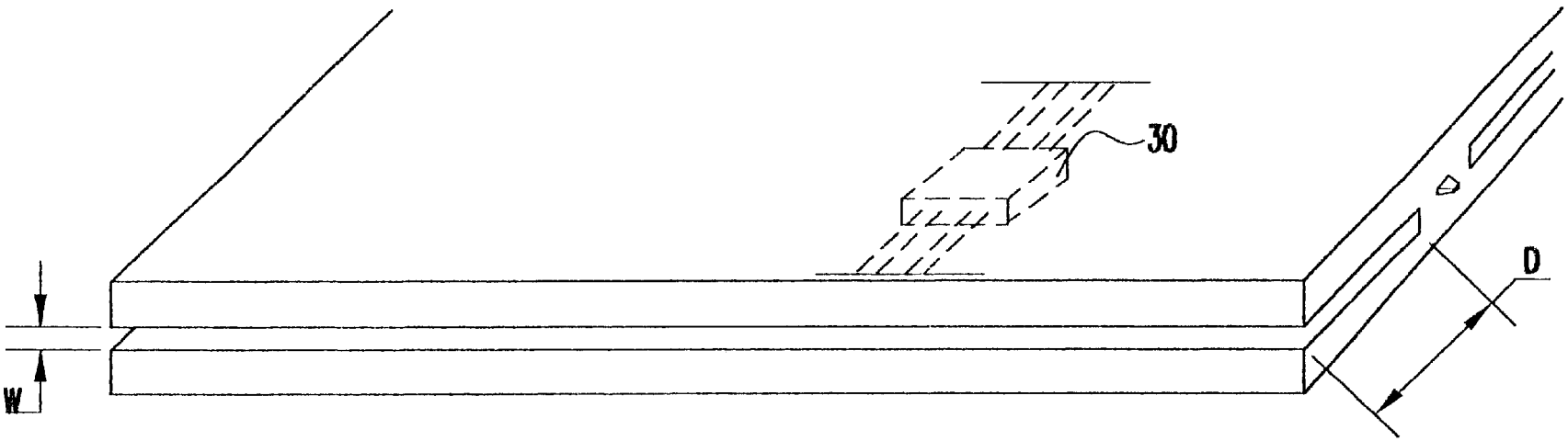
FIG. 4 is a diagram showing an exemplary arrangement of the personal computer of the invention equipped with a printhead which only moves in a transverse direction relative to the transport path.
Figure 5:
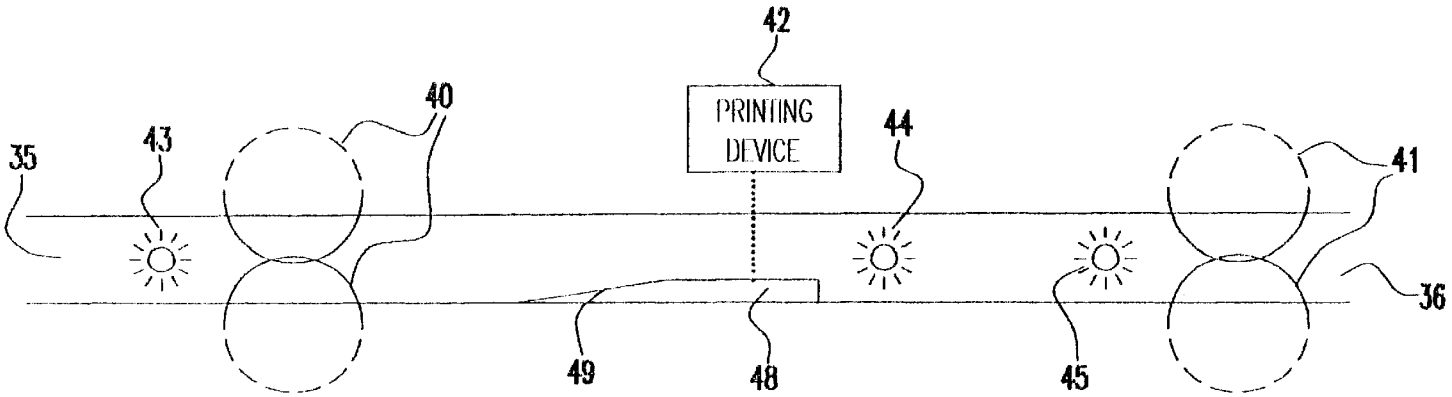
FIG. 5 shows an internal arrangement of the transport path of the invention operating either with a fixed printing device as shown in FIG. 1 or a printing device which moves with one degree of freedom in the transverse direction as shown in FIG. 4.

The transport path of the invention may be configured based on the type of printing device selected. FIG. 4 shows an exemplary arrangement for a printing device having a printhead 30 which only moves in a transverse direction relative to the transport path. FIG. 5 shows an internal arrangement of the computer of the present invention containing either a fixed printing device as shown in FIG. 1 or a printing device which moves as shown in FIG. 4.

In FIG. 5, the transport path includes a pair of front feed rollers 40 and a pair of back feed rollers 41 with a printhead 42 situated in between. The rollers are powered by a motor (not shown) within the housing. The path also includes a number of sensors for detecting the position of a print medium as it moves along the path. These sensors include a sensor 43 for detecting when a user has inserted a print medium into an entrance 35 of the slot, a sensor 44 for detecting when the print medium has reached a print position underneath the printing device, and a sensor 45 for detecting when the medium approaches an exit 36 of the transport path, for example, after printing has been completed.

Operation of the rollers is coordinated with the sensor outputs to guide the print medium through the transport path before, during, and/or after printing. For example, when sensor 43 detects that a print medium has been inserted into the entrance of the slot by a user, a control circuit (not shown) causes front rollers 40 to rotate in a manner which advances the medium toward the printing device. Sensor 44 detects when the medium has advanced to the print position (e.g., the standard position of a stamp on a letter), in response to which the control circuit coordinates rotation of the front rollers in synchronization with the information printed by the printing device. When printing is complete, the front rollers advance the print medium until the medium is detected by sensor 45. The control circuit then rotates the back rollers 41 to discharge the print medium through the exit of the slot.

For instances where the amount of information to be printed is greater than the distance between the printing device and the back rollers, the control circuit coordinates the movement of all the rollers with the printing device until printing is complete and the medium is discharged. As shown, the optional feature of a platen 48 may be included in the transport path directly underneath the printing device to improve stability of the medium during printing. A front edge 49 of the platen may be angled to urge the medium into the print position. (As those skilled in the art can appreciate, other conventional features for stabilizing the print medium during printing may be included, if needed).

Figure 6:
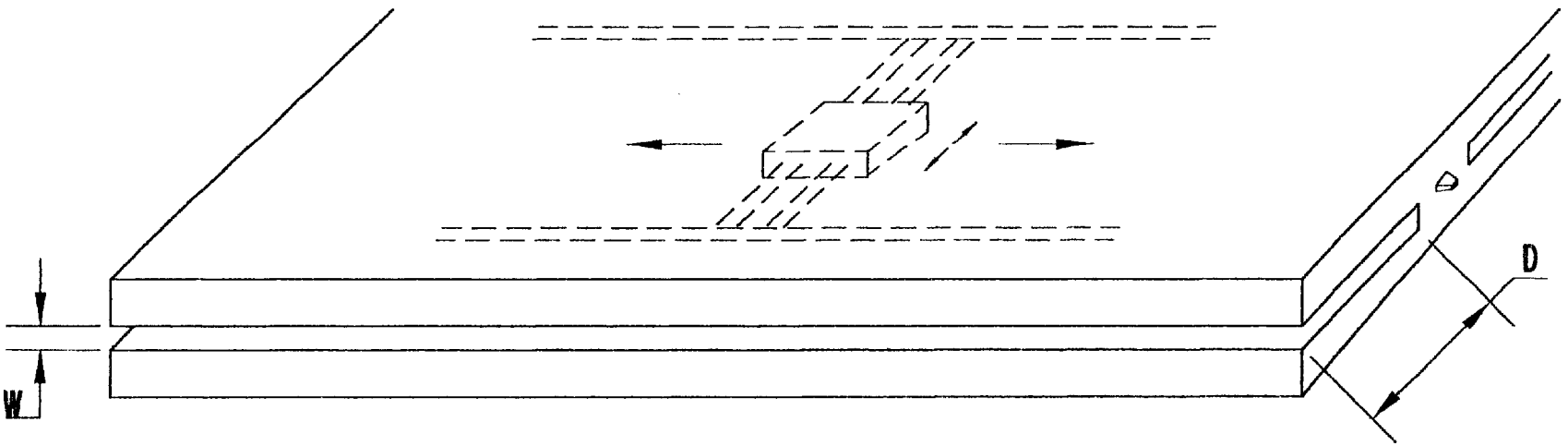
FIG. 6 is a diagram showing an exemplary arrangement of the personal computer of the invention equipped with a printhead which moves in transverse and parallel directions relative to the transport path.
Figure 7:
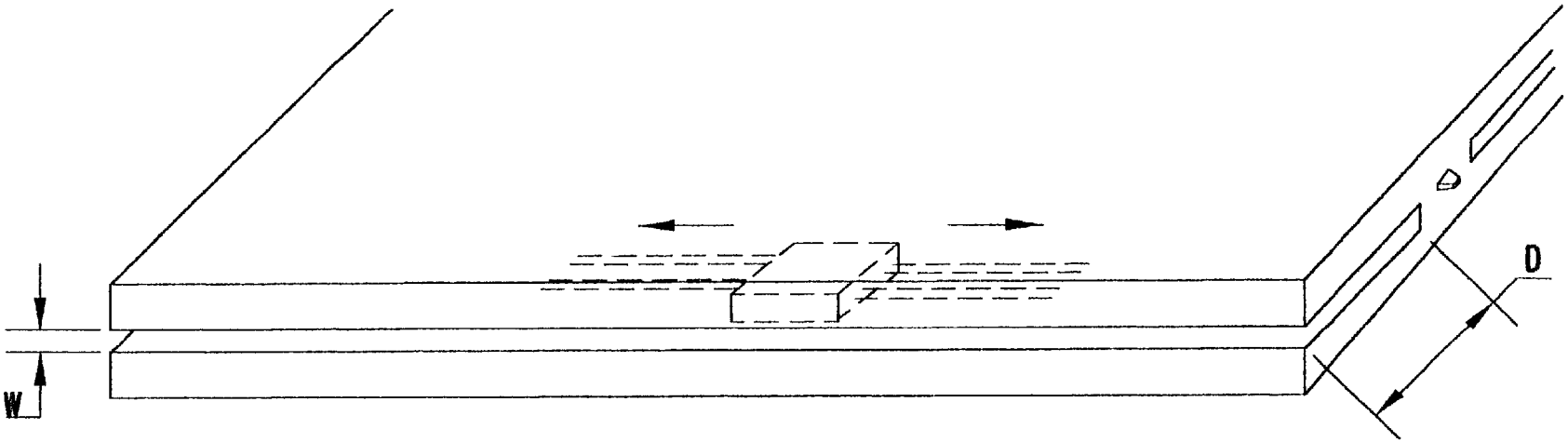
FIG. 7 is a diagram showing an exemplary arrangement of the personal computer of the invention equipped with a printhead which only moves in a parallel direction relative to the transport path.

FIG. 6 shows an exemplary arrangement for a printing device having a printhead which moves in transverse and parallel directions relative to the transport path, and FIG. 7 shows an exemplary arrangement for a printing device having a printhead which only moves in a parallel direction relative to the transport path.

Figure 8:
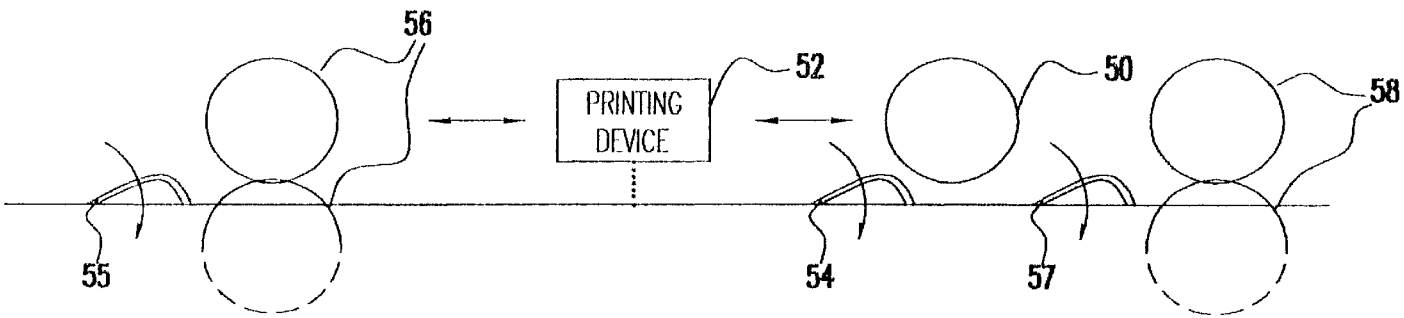
FIG. 8 is a diagram showing an internal arrangement of the transport path of the invention operating with either a printhead with moves with two degrees of freedom as shown in FIG. 6 or a printhead which moves with one degree of freedom in the parallel direction relative to the transport path.

FIG. 8 is a diagram showing an internal arrangement of the transport path equipped with a printhead as shown in either of FIGS. 6 and 7. In this arrangement, the transport path is arranged in a manner similar to FIG. 5 except that clearance is provided between the front and back rollers to allow the printhead to move parallel to the transport path. Also, a stop roller 50 is provided to stop the medium so that the medium lies within a printing range relative to movable printhead 52. The roller 50 engages the medium when position sensor 54 detects the presence of a leading edge of the print medium. When printing is complete, a control circuit may engage one or both of rollers 50 and roller 56 to advance the medium to the back rollers 58 where the medium is then discharged from the transport path. Sensors 55 and 57 are mechanical members which deflect downwardly under weight of the print medium. Otherwise, they perform the same functions as sensors 43 and 45 in FIG. 5.

The arrangements shown in FIGS. 5 and 8 are merely illustrative of the present invention. Those skilled in the art can appreciate that the transport path may be configured according to any conventional design which is consonant with the type of printing device in use, which increases the stability of the print medium during printing, and which provides enhanced control for moving the medium through the transport path from start to finish. Also, it can be appreciated that the position sensors used in accordance with the invention may be of any conventional type and thus are not restricted to infrared sensors and mechanical arm sensors which have been illustratively described above.

In all of the embodiments described herein, printer driver software may be stored in a memory of the personal computer for driving the rollers and printhead/carriage assembly as required in order to print information onto a print medium in accordance with an application program also being executed by the personal computer. Further, the housing of the computer of the present invention may be extended, as needed, in order to accommodate the printhead, ink/toner source, rollers, sensors, and support structures of each type of printer.

Figure 9:
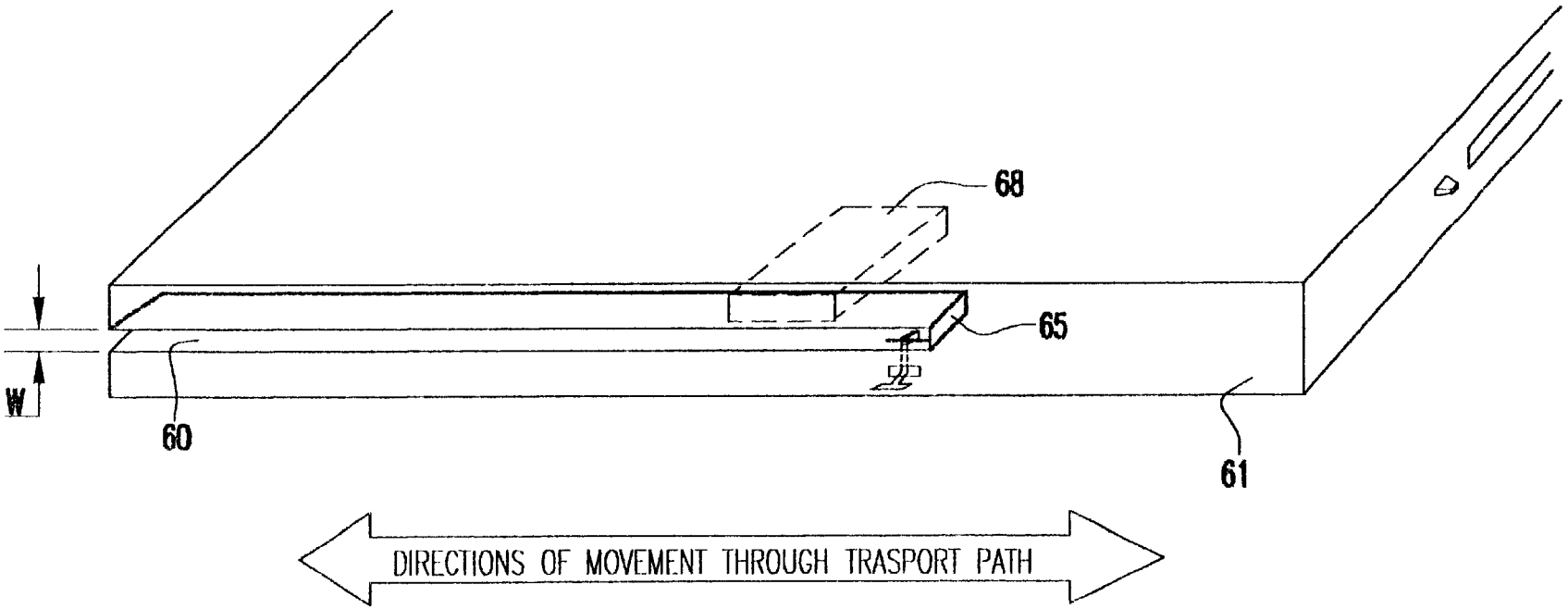
FIG. 9 is a diagram showing a second embodiment of the personal computer of the present invention.

Referring to FIG. 9, second embodiment of the personal computer of the present invention is similar to the first embodiment except that it includes a slot 60 which only partially extends along a surface of a housing 61. As shown, the slot terminates with a side wall 65 which extends perpendicularly to a transport path created by the slot. The side wall performs at least two functions. First, it acts as a stop for defining the extent to which a print medium may be inserted into the slot by a user. Second, the wall is positioned a distance from printing device 68 to ensure that the print medium rests at a print position when a forward edge of the medium abuts the side wall.

Figure 10:
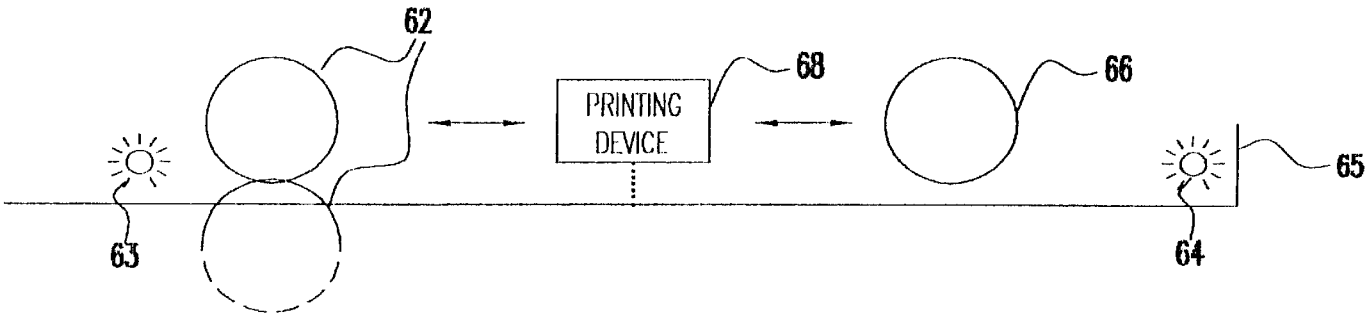
FIG. 10 is a diagram showing an internal arrangement of the transport path in accordance with a second embodiment of the personal computer of the present invention.

The printing device may be stationary or have multiple degrees of freedom, as previously described. Further, as shown in FIG. 10, the slot may be equipped with a pair of rollers 62 for automatically feeding the print medium to the print position when a sensor 63 detects that the medium has been inserted into the transport path by a user. A sensor 64 may be included adjacent the back wall of the slot to confirm that the medium has been advanced to a print position. Further, a roller 66 may be included at a position between the printing device and rear wall to hold the medium in a stable position during printing. (Other conventional members may also be used for increased stability). When printing is complete, rollers 62 may be operated in reverse to automatically discharge the print medium from the slot.

According to one alternative arrangement, front feed rollers 62 may be omitted altogether. In this arrangement, a user merely inserts a print medium into the slot by hand until its leading edge abuts side wall 65. Sensor 64 detects the print medium at the print position and outputs a signal to control software in the computer. The software instructs the printing device to print the desired information, after which the user manually removes the print medium from the slot. The user may rely on the sound of the printing device as a guide as to when to remove the print medium. If desired, slot 60 may be further equipped with an mechanical stop member which is either fixed to define a predetermined print position or adjustable to match the sizes of varying print media.

Figure 11:
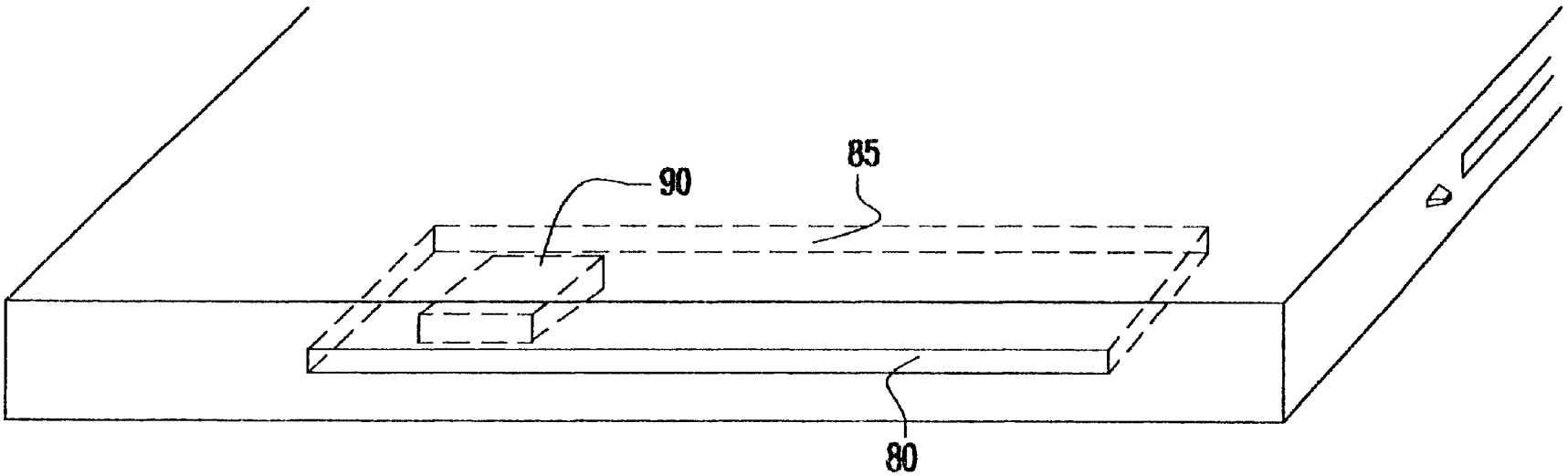
FIG. 11 is a diagram showing a third embodiment of the personal computer of the present invention.

Referring to FIG. 11, a third embodiment of the personal computer of the present invention includes a slot 80 formed along one of its side surfaces. Unlike the previous embodiments, slot 80 defines a transport path which is oriented in a transverse direction relative to the surface of the computer housing into which the slot is formed. Operationally, however, the third embodiment is similar to the second embodiment.

Specifically, as shown, slot 80 terminates with a back wall 85. The position of this back wall may serve to orient an inserted print medium into a print position, i.e., when a leading edge of a print medium abuts back wall 85 the print medium is considered to be in a print position relative to printing device 90. The printing device may be stationary or have multiple degrees of freedom, as previously described. Further, like other embodiments, the slot may be equipped with a pair of rollers and sensors for automatically feeding the print medium to the print position (i.e., against the back wall) when operating in a forward direction and then expelling the medium after printing when operated in a reverse direction.

Alternatively, the slot may contain no feed rollers. Instead, a sensor may be incorporated within the slot near wall 85 to detect the presence of a print medium at a print position. With this arrangement, a user merely inserts a print medium into the slot by hand until its leading edge abuts wall 85. The sensor detects the print medium at the print position and outputs a signal to control software in the computer. The software instructs the printing device to print the desired information, after which the user removes the print medium from the slot. The user may rely on the sound of the printing device as a guide as to when to remove the print medium.

Figure 12:
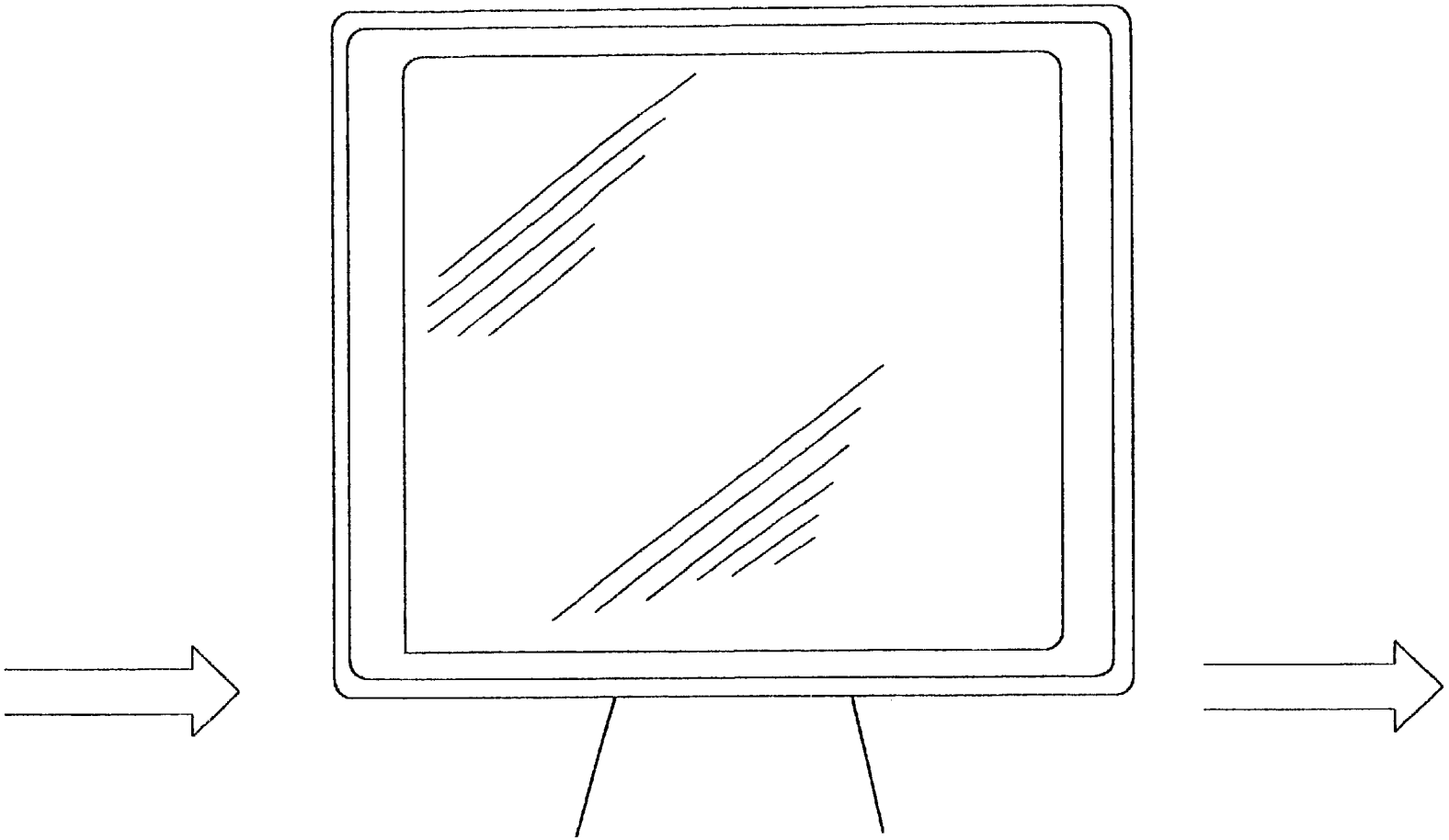
FIG. 12 is a diagram showing an embodiment of the present invention which includes a flat-panel display having an integrated printer and slot formed along its front surface.
Figure 13:
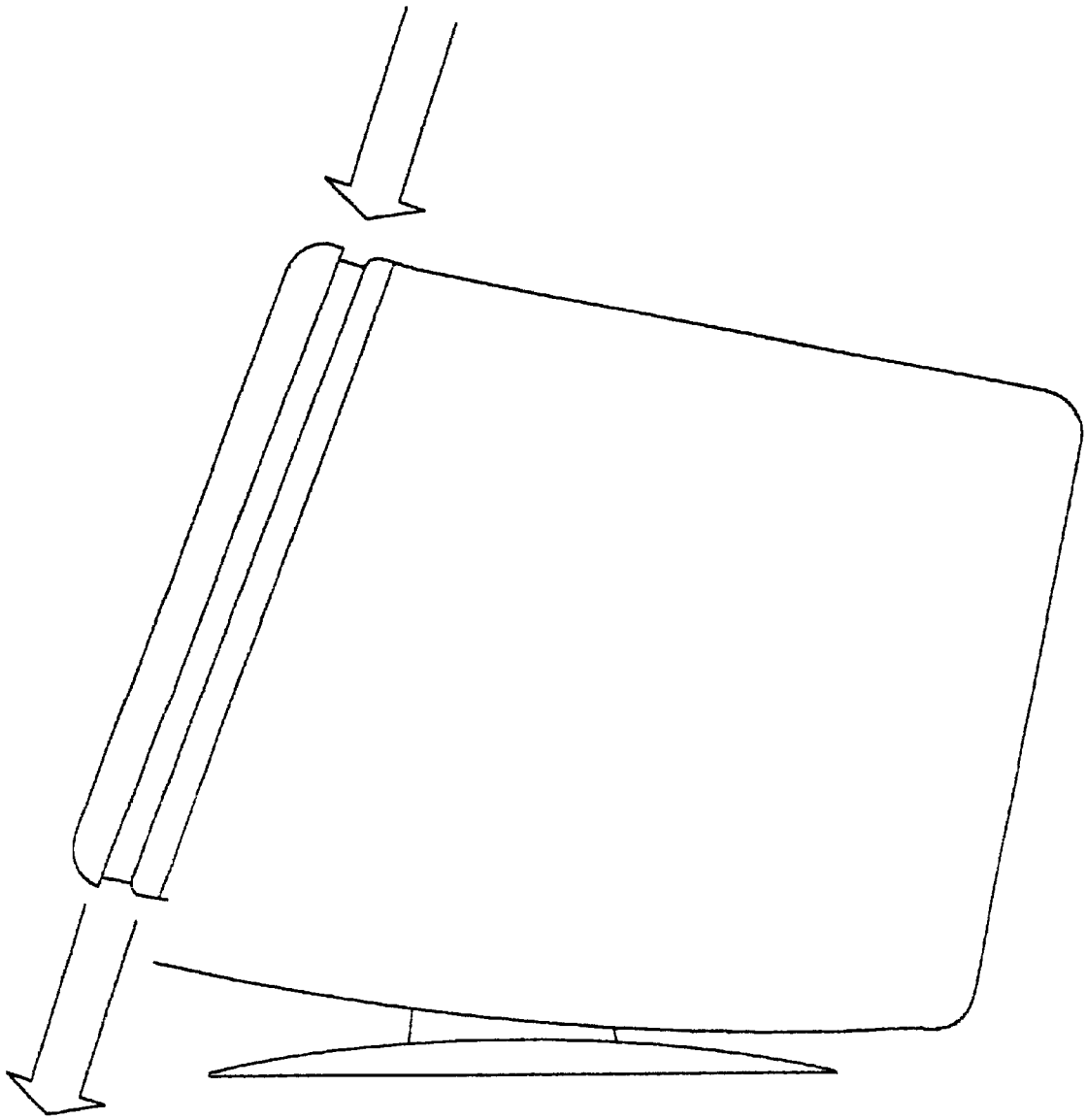
FIG. 13 is a diagram showing an embodiment of the present invention which includes a CRT display having an integrated printer and slot formed along its side surface.
Figure 14:
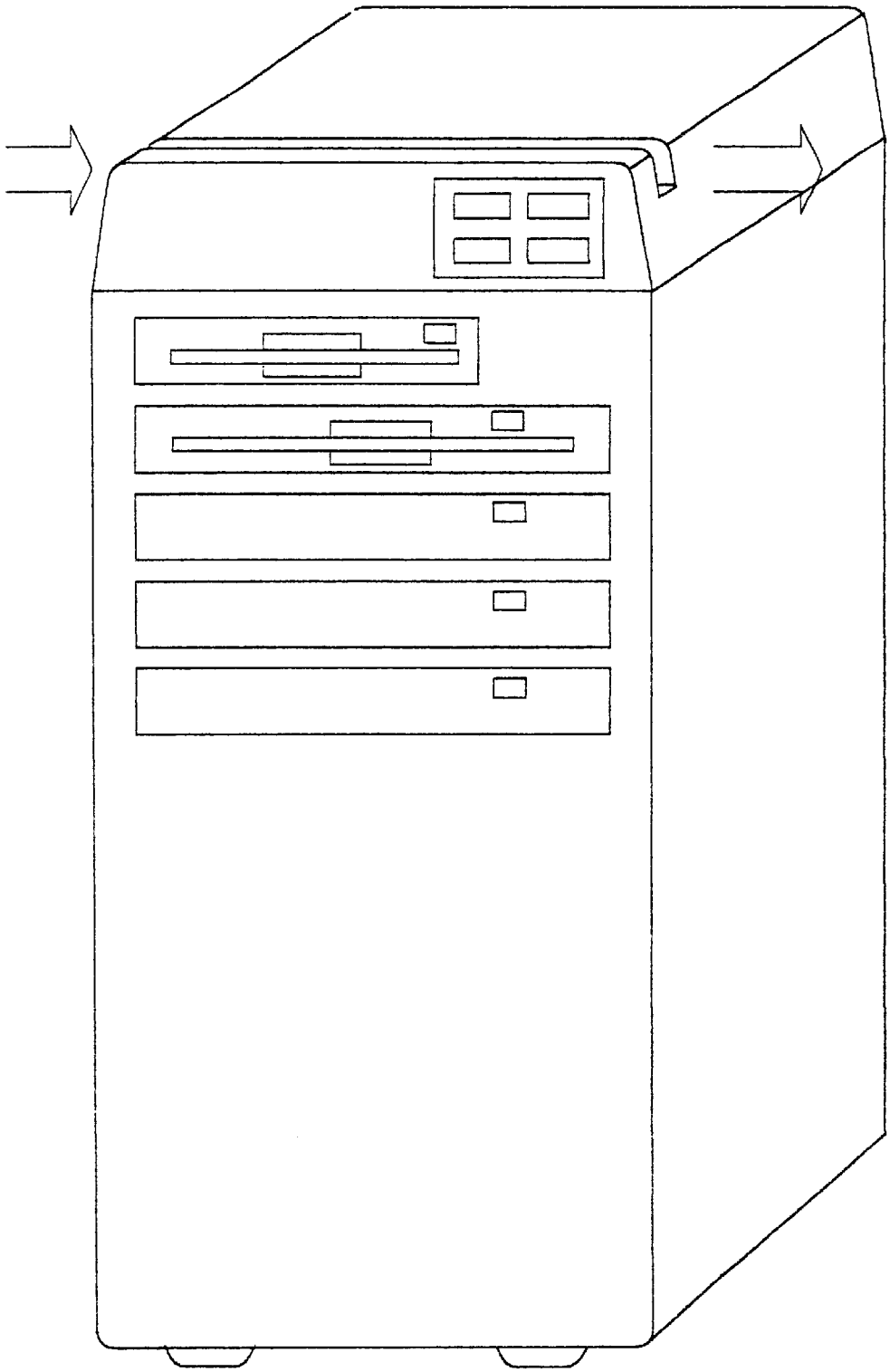
FIG. 14 is a diagram showing an embodiment of the present invention which includes a CPU having an integrated printer and slot formed along its top surface.
Figure 15:
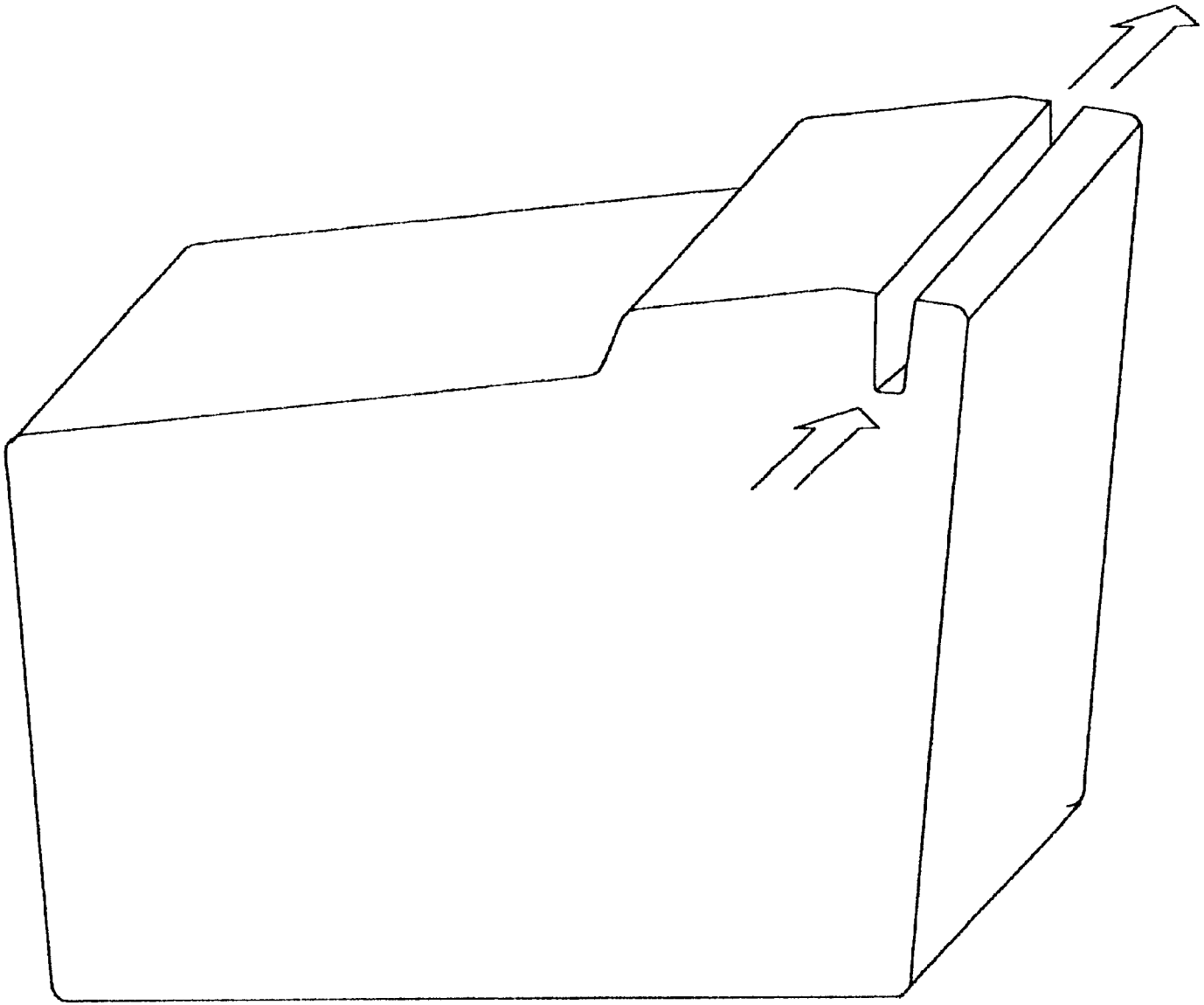
FIG. 15 is a diagram showing an embodiment of the present invention which includes a laser printer having an integrated printer and slot formed along its top surface.
Figure 16:
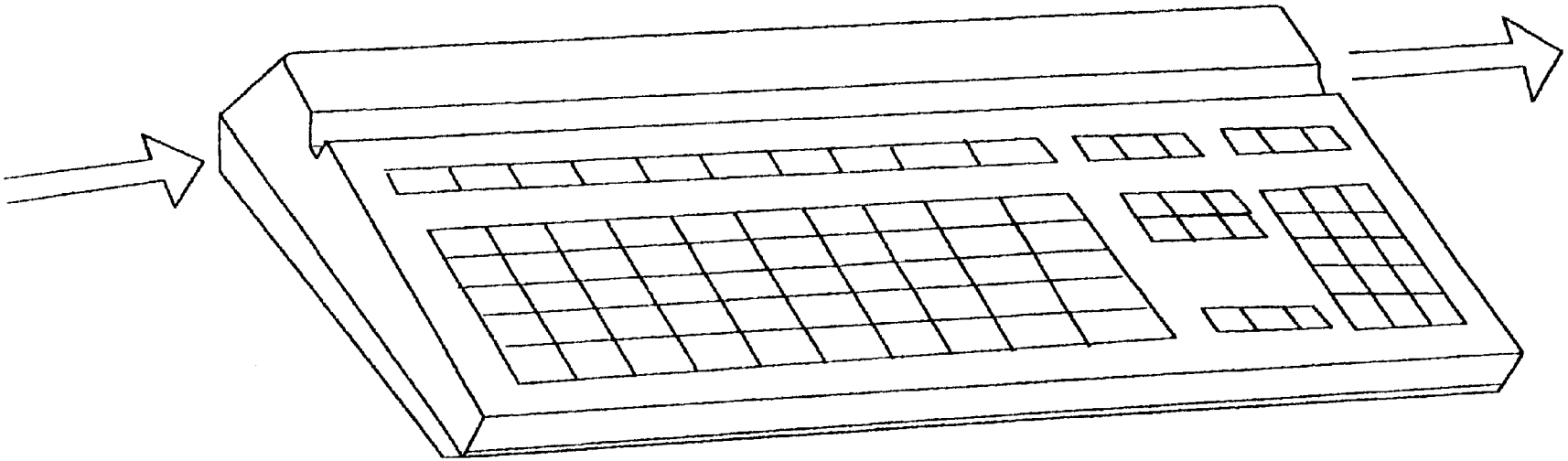
FIG. 16 is a diagram showing an embodiment of the present invention which includes a keyboard having an integrated printer and slot formed along its top surface.

The present invention also contemplates a printer formed into any one of a number of individual components which make up or are peripheral to a personal computer. FIG. 12 shows an embodiment of the present invention in the form of a flat-panel display having an integrated printer and slot formed along its front surface. FIG. 13 shows a CRT display having an integrated printer and slot formed along its side surface. FIG. 14 shows a CPU having an integrated printer and slot formed along its top surface. FIG. 15 shows a laser printer having an integrated printer and slot formed along its top surface. FIG. 16 shows a keyboard having an integrated printer and slot formed along its top surface. The integrated printer in each of FIGS. 12–16 may be similar in structure and operation to the embodiments previously discussed herein. If necessary, the housing of each of these components may be extended to accommodate the printhead, carriage assemblies, rollers, sensors, and other printer and paper transport elements, as well as to provide sufficient clearance for a slot of a desired depth. Like in the embodiments previously explained, these features may run off of battery power or the power of the component. Also, those skilled in the art can appreciate the location of the slot in each of these figures is merely illustrative of the invention, as the slot may be located along any surface desired.

The system and method of the present invention use the personal computer described heretofore for printing information (e.g., a postage mark, address information, advertising information, class-of-mail information, return address information) on envelopes, postcards, business packages, and other items of mail. The postage mark may be expressed as a bar code or any other mark indicative of postage.

Figure 17:
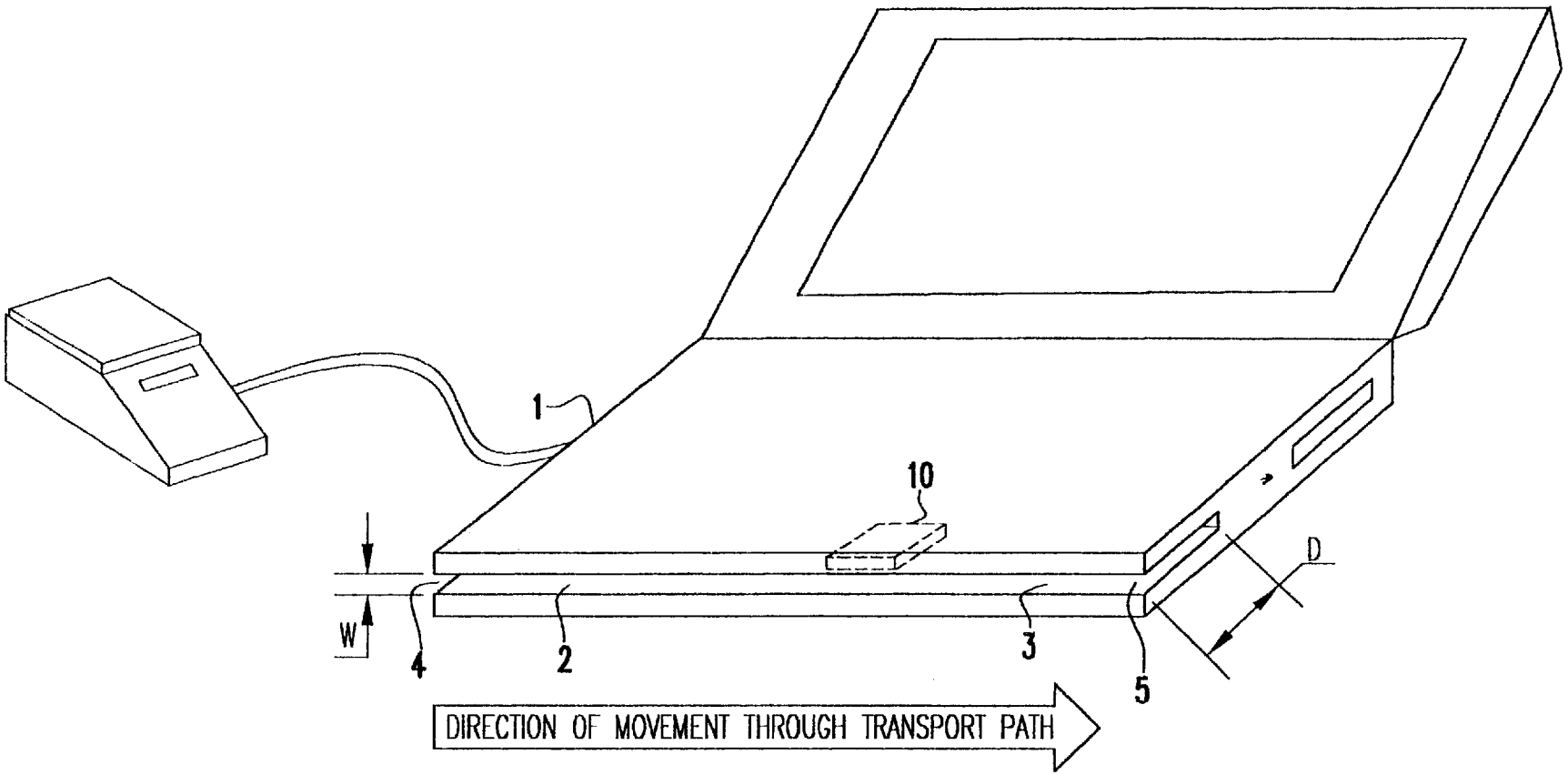
FIG. 17 is a diagram showing the system of the present invention incorporating, by way of example, the personal computer shown in FIG. 1.

As shown in FIG. 17, this system includes the personal computer of the present invention preferably connected to an electronic scale. (While the specific computer of FIG. 1 is shown, those skilled in the art can appreciate that any of the embodiments of the computer described herein may be connected.) The computer is loaded with an application program which computes private carrier and/or postal rates observed in this and/or another country in the world. A program for computing domestic postage is disclosed, for example, in U.S. Pat. No. 5,606,507. The electronic scale may be any type conventionally known which is adapted for outputting weight measurement signals in a form understandable by the postage-computing program.

Figure 18:
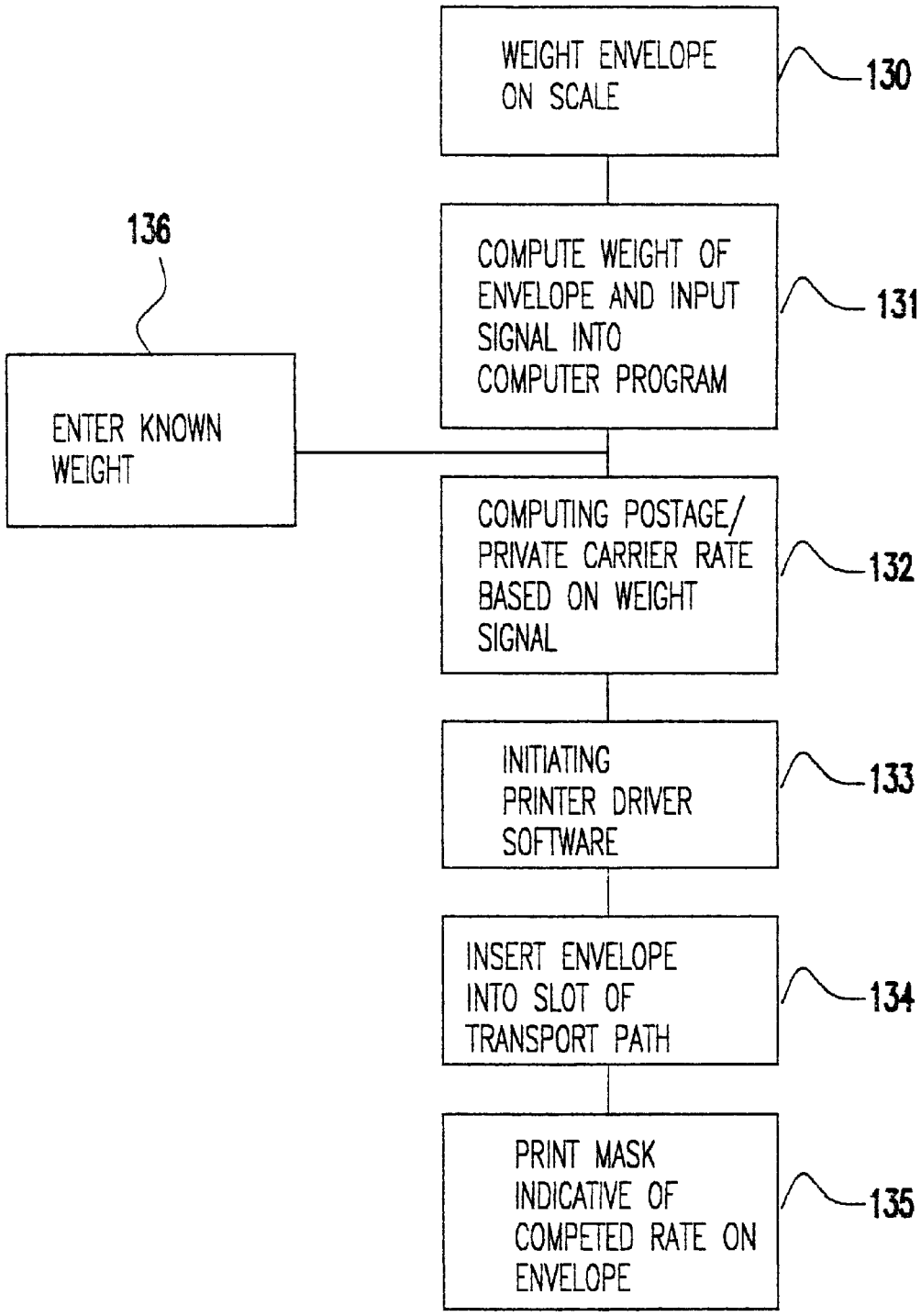
FIG. 18 is a diagram showing steps included in the method of the present invention for printing a mark indicative of a postage or private carrier rate onto a envelope.

The method of the present invention, as performed by the above-described system, includes the following steps for printing postage as shown in the flow diagram of FIG. 18. The method begins with a user weighing an item of mail (e.g., envelope) on the scale. (Block 130). A signal corresponding to the weight of the envelope is input into the rate-computing program running on the computer. (Block 131). In the instance where the scale is electronically connected to a communications port of the computer, the step in Block 131 is performed automatically. However, if desired, the scale may be an electronic scale which is detached from the computer or a traditional, non-electronic analog scale. In these latter cases, the weight of an item of mail is input into the program by hand using the computer keyboard. (Block 136).

Figure 19:
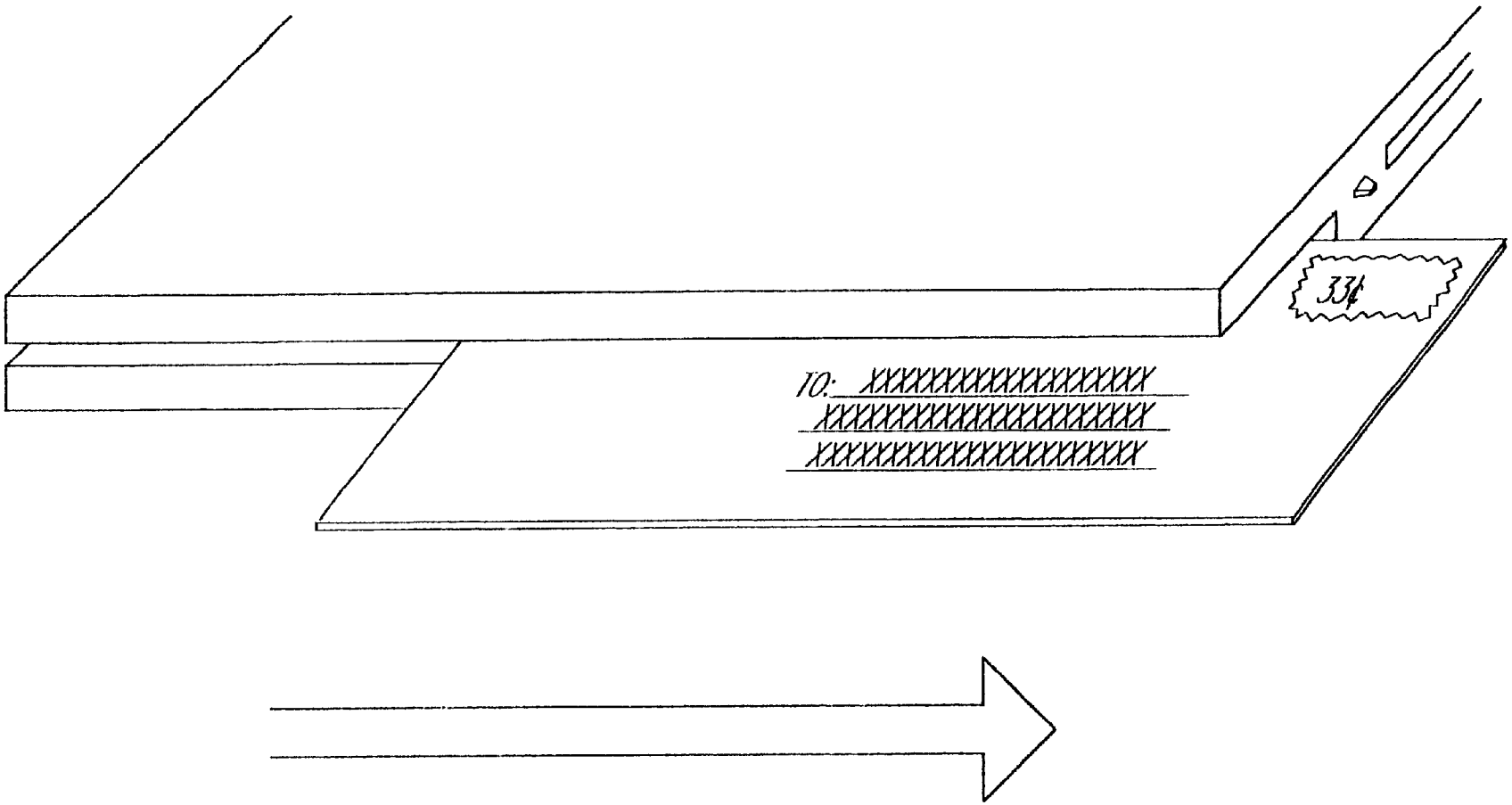
FIG. 19 is a diagram showing an envelope printed in accordance with the method of the present invention.

The method continues with the program computing a postage or private carrier rate (Block 132) and then initiating driver software for controlling the built-in printer. (Block 133). Once initiated, a user inserts the envelope into the entrance of the transport path. (Block 134). The printing device along the path then prints a stamp onto the envelope (e.g., at the upper right-hand comer) in accordance with the present invention as previously described (Block 135, thereby completing the method. FIG. 19 shows the final product of the method using the personal computer shown in FIG. 1.

Figure 20:
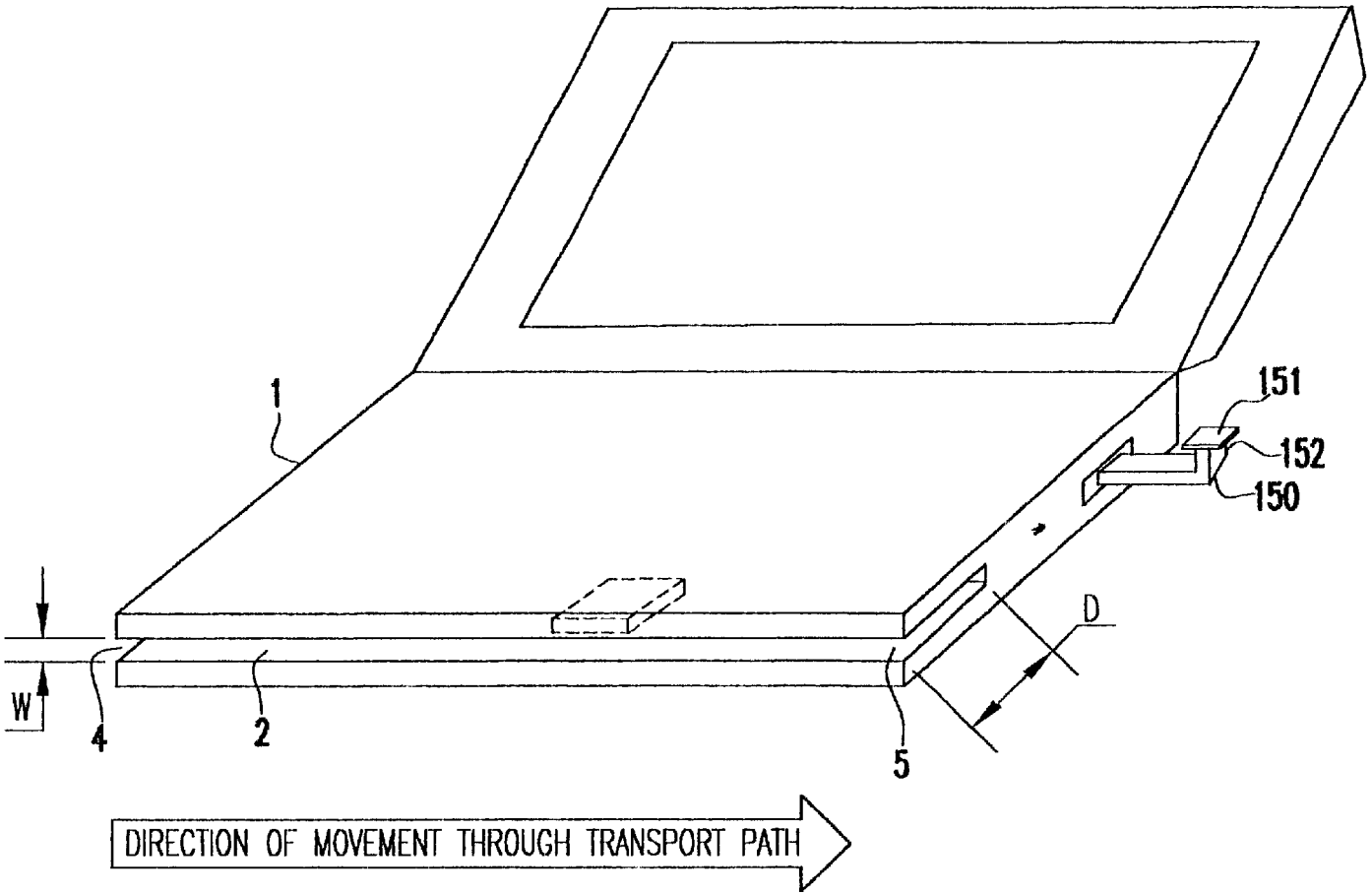
FIG. 20 is a diagram showing the system of the present invention which includes a removable scale cartridge inserted into a personal computer as described in the embodiments set forth herein.

One particularly advantageous embodiment of the system of the present invention is shown in FIG. 20. This system includes a personal computer according to the present invention adapted for use with a removable scale cartridge 150 of the type disclosed in U.S. patent application Ser. No. 09/584,098, the contents of which is incorporated herein by reference. This scale includes a platform 151 connected to a weighing unit (not shown) which is at least partially enclosed within a housing 152 of the scale. In operation, a user places an item of mail on the scale. The weighing unit then outputs a signal indicative of a weight of a mail item through a connector of the scale which is mated to a communication (e.g., PCMCIA) port of the computer. The weight signal is received by the rate-computing program wherein a desired rate is computed. A stamp is then printed on the mail item (e.g. envelope) by inserting it into the transport path of the computer in accordance with the method of the present invention described herein.

Figure 21:
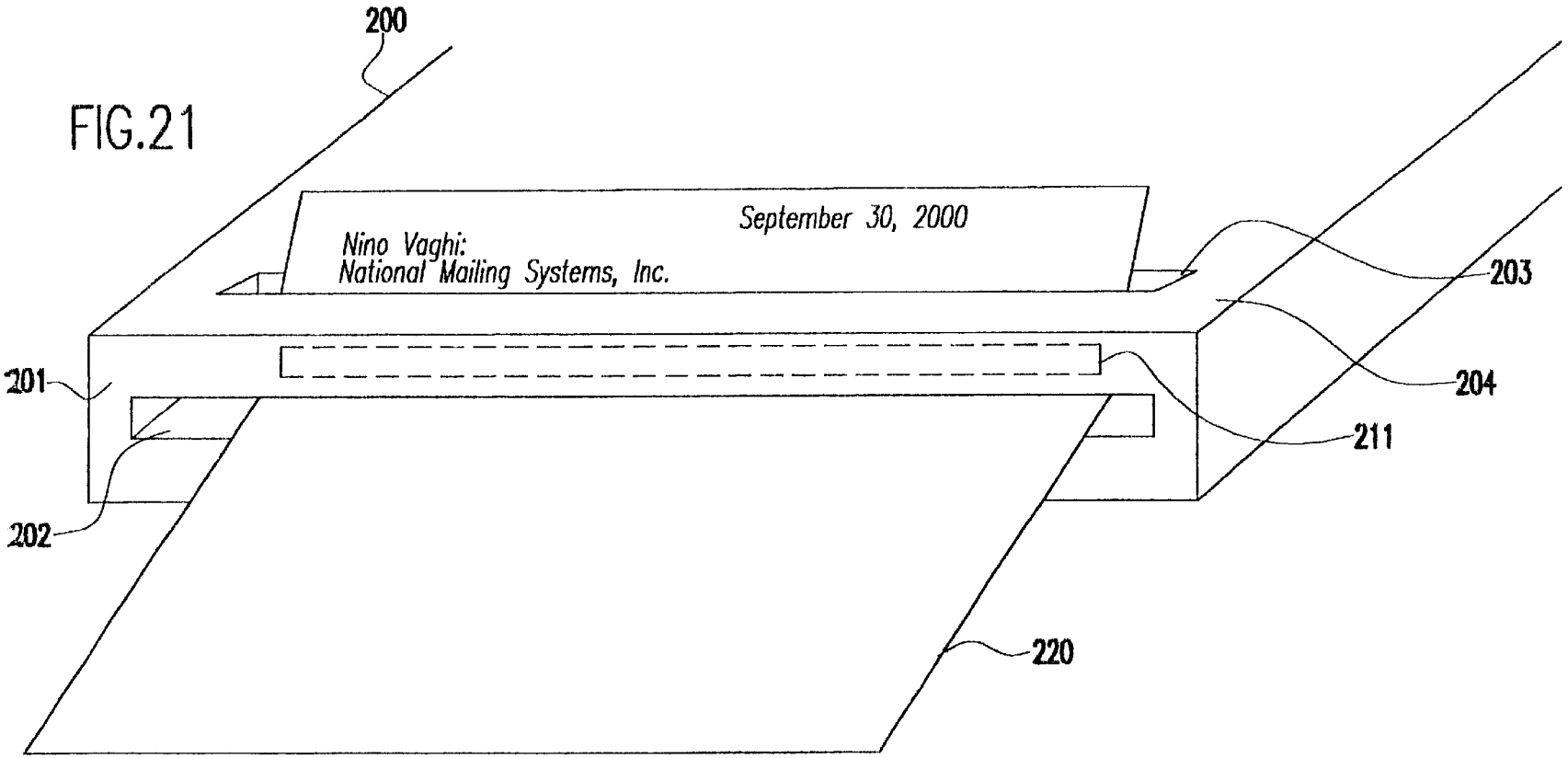
FIG. 21 is a diagram of another embodiment of the personal computer of the present invention equipped with a paper transport path arranged perpendicular to a front surface of the computer housing.
Figure 22:
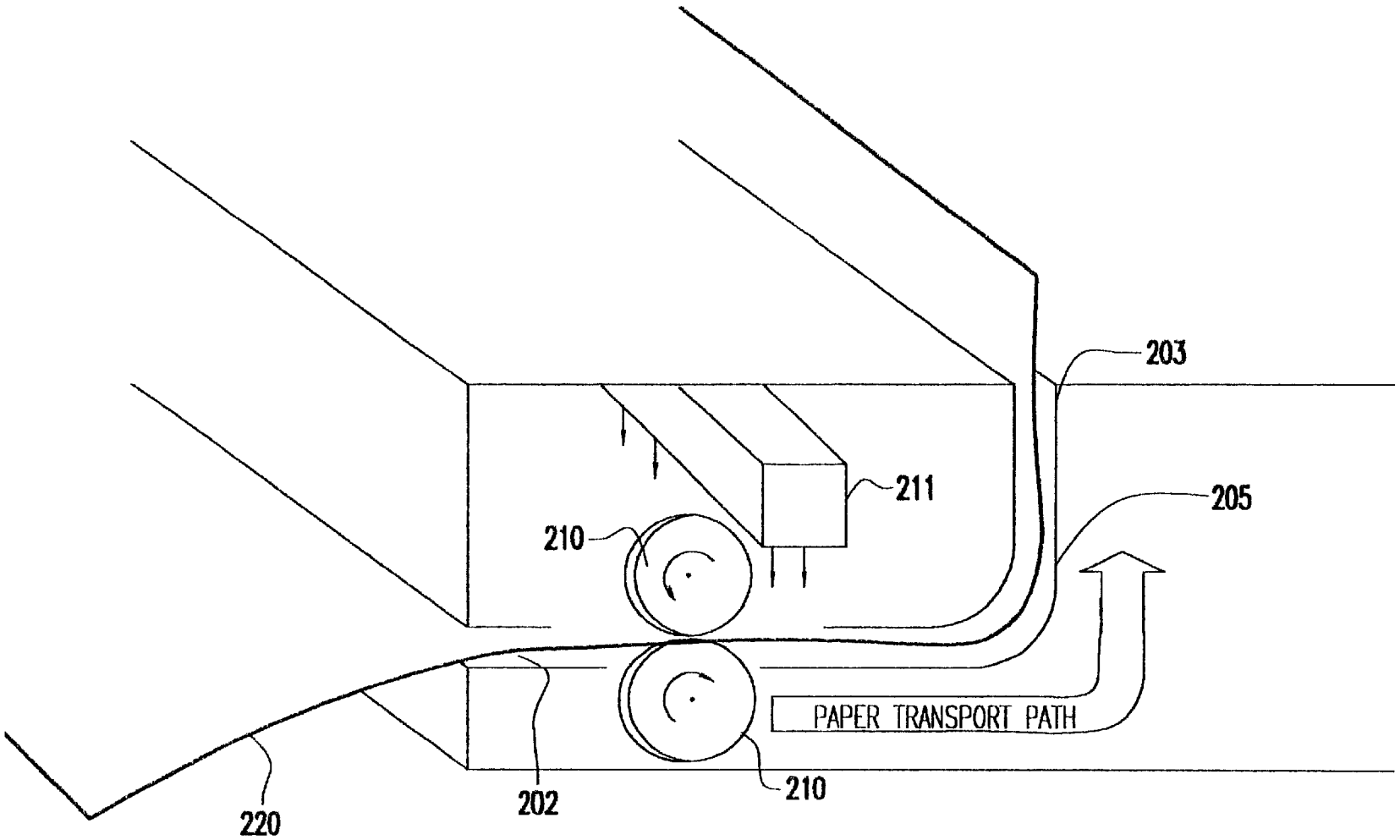
FIG. 22 is a diagram showing a cross-sectional view of the computer shown in FIG. 21.

FIGS. 21 and 22 show another embodiment of the personal computer 200 of the present invention. In this embodiment, a paper transport path is arranged perpendicular to a front surface 201 of the computer housing. This path is defined by an input slot 202 along the front surface, an output slot 203 along a top surface 204 of the housing, and a curved portion 205 within the housing for connecting the input and output slots. These surfaces of the housing may be expanded, as required, to accommodate the transport path and its accompanying printing elements.

Internally, the computer is equipped with rollers 210 for catching and advancing a sheet of paper 220 along the transport path. A printing element 211 prints on the sheet of paper as it is advanced under control of printer driver software stored in the computer. The printing element may be any of the types previously described. Preferably, the printing element is an ink jet array which spans an entire width of the sheet of paper. This allows the computer of the invention to perform full text printing under control of any one of a variety of application programs stored in memory, including word processing programs, spread sheet applications, databases, and graphics packages just to name a few. The integrated printer of the present invention, thus, provides a user with full office word processing and printing capability within a single, compact mobile unit. The printhead may also define a printing range smaller than the width of the paper to target a specific location thereon.

As with the other embodiments, the ink source for the printing element may advantageously be accommodated within the computer housing. For the ink-jet embodiments, a replaceable ink cartridge may be sized to fit within the interior space. A slidable door may be formed in the housing to allow a user to replace the cartridge without assistance from a technician.

In operation, a user inserts a sheet of paper into the input slot until its leading edge is pinched between the rollers. Then, when a print command is initiated by a user within an application program, the rollers advance the paper past the printing element until printing is complete. If desired, a second set of rollers may be positioned near the output slot to fully eject the paper at this time.

Forming the paper transport path of the invention along the front portion of the housing represents a significant improvement compared with conventional printer-integrated laptop computers, such as disclosed in U.S. Pat. No. 5,443,320. In these conventional computers, the paper transport path extends underneath the keyboard, terminating with an output port directly in front of the display screen. Such an arrangement is undesirable because the keyboard must be specially designed to be removable. Also, the internal electronics, disk drives, and other peripheral and input devices of the computer must be re-arranged, all of which complicates the manufacturing process and increases costs.

The present invention overcomes all of these drawbacks by forming its paper transport path in front of the keyboard. In this position, the internal electronics may be placed in standard mounting positions, thereby making the invention cheaper to manufacture and thus more competitive in terms of its sales price. Also, the invention is easier to use because the keyboard does not have to be removed before printing.

If desired, the paper transport path may be placed along other surfaces of the computer. For example, the positions of the input and output slots may be switched, so that the input slot is formed along the top surface and the output slot along the front surface. Alternatively, a side surface of the housing may be expanded, as required, to accommodate the transport path of the invention.

Figure 23:
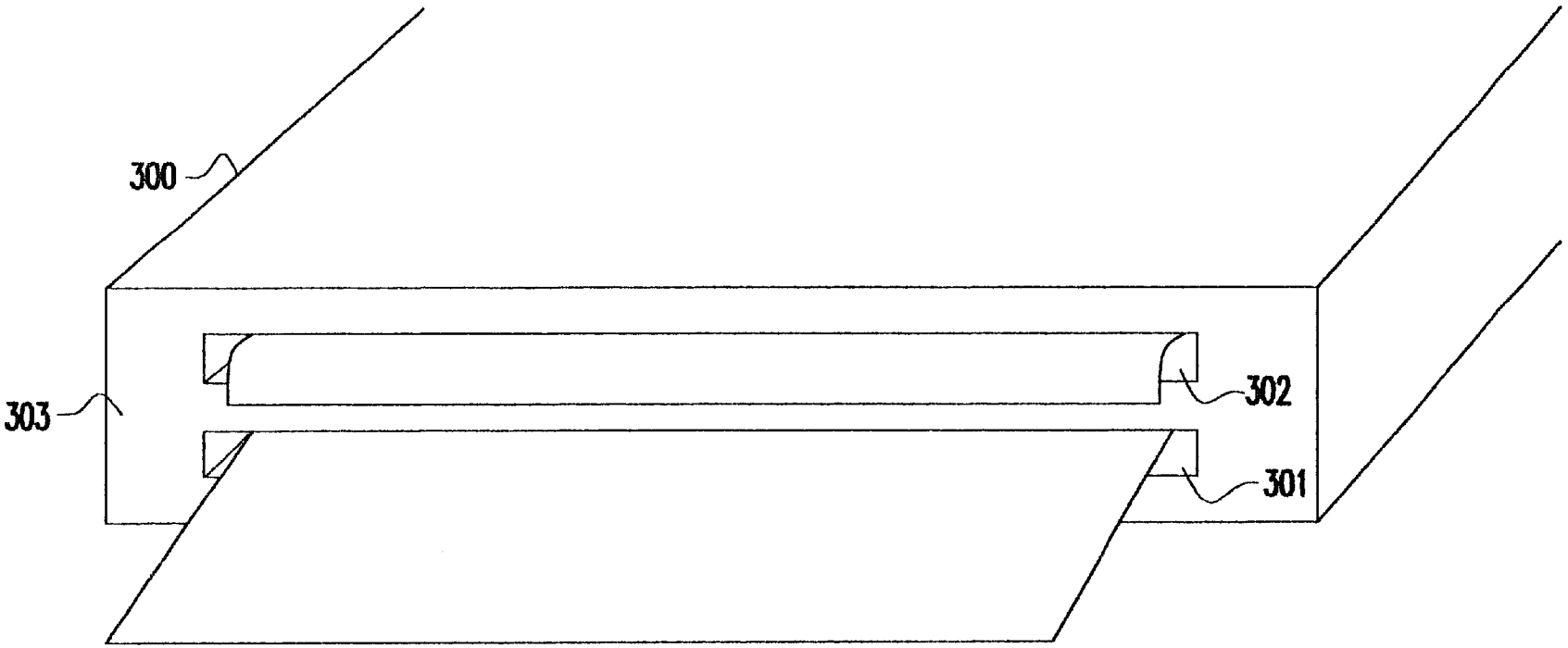
FIG. 23 is a diagram of another embodiment of the personal computer of the present invention equipped with a paper transport path arranged perpendicular to a front surface of the computer housing.
Figure 24:
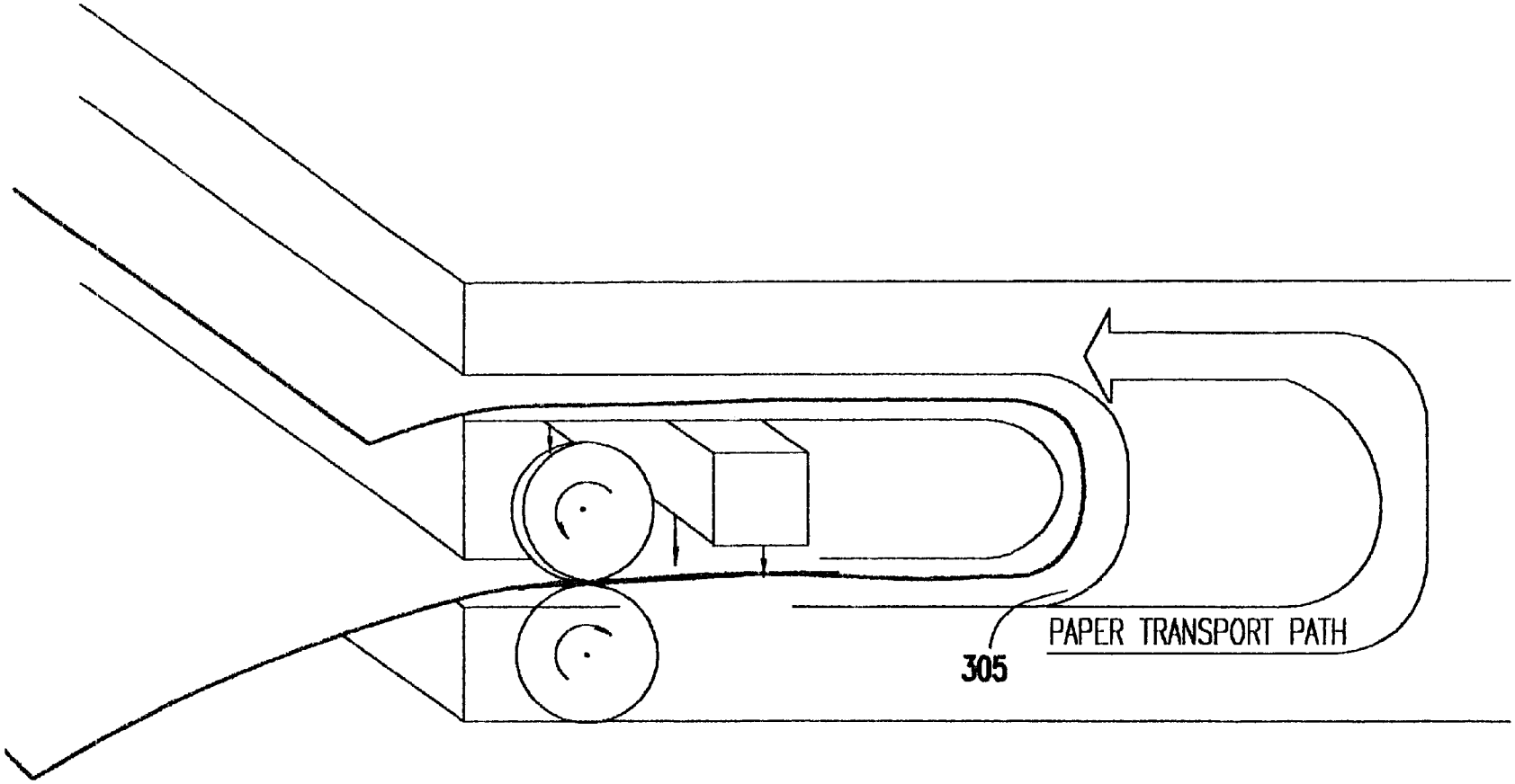
FIG. 24 is a diagram showing a cross-sectional view of the computer shown in FIG. 23.

FIGS. 23 and 24 show another embodiment of the personal computer 300 of the present invention. This embodiment is similar to the embodiments shown in FIGS. 21 and 22 except that the output slot 302 of the paper transport path is arranged along the same surface as input slot 301 and a U-shaped portion 305 connects the slots. FIG. 23 illustratively shows this surface to be a front surface 303 of the computer housing. Those skilled in the art can appreciate, however, that any surface of the housing may accommodate the input and output slots. Although not shown, a second set of rollers may be arranged along the transport path adjacent the output slot to help eject a printed page during and after printing. In all other respects, this embodiment is similar to the FIGS. 21 and 22 embodiment.

Other modifications and variations to the invention will be apparent to those skilled in the art from the foregoing disclosure. Thus, while only certain embodiments of the invention have been specifically described herein, it will be apparent that numerous modifications may be made thereto departing from the spirit and scope of the invention.

For example, while the slot in each embodiment described herein is shown as being formed along a front side surface of the computer, those skilled in the art can appreciate that the slot and printing device of the present invention may be oriented along any other surface of the computer, including any other side surface, a top surface or a bottom surface. Moreover, if the computer is a notebook, the slot and printing mechanism may be integrated along a surface which includes the display portion of the computer such as along its periphery.

What is claimed is:

1. A system for printing postage on an item of mail, comprising:

a personal computer having a processing unit which runs an application program for computing postage and/or private carrier rate information, said application program computing postage based on information indicative of a weight of said item of mail;

a slot located along a surface of a housing of said personal computer;

a printer included within said housing at a location adjacent said slot, said printer printing onto said item of mail a mark indicative of said rate information computed by said application program; and an electronic scale for weighing an item of mail.

2. The system of claim 1, wherein said personal computer is a portable personal computer.

3. The system of claim 1, wherein said electronic scale is a removable scale cartridge inserted into said personal computer.

4. The system of claim 3, wherein said removable scale cartridge includes:

a platform for supporting an item;

a weighing unit which outputs a weight signal corresponding to a weight of said item supported on the platform; and an electrical connector part which is adapted for coupling with a complementary connector part in said personal computer, said electrical connector part including one of a plug and a receptacle and said complementary connector part including the other of said plug and receptacle, wherein when said plug is inserted into said receptacle said weighing unit outputs the weight signal to said personal computer.

5. The system of claim 1, wherein said slot has a depth which defines a maximum printing range of said printer relative to a print medium inserted into said slot.

6. A system for printing postage on an item of mail, comprising:

a personal computer having a processing unit which runs an application program for computing postage and/or private carrier rate information, said application program computing postage based on information indicative of a weight of said item of mail;

a slot located along a surface of a housing of said personal computer;

a printer included within said housing at a location adjacent said slot, said printer printing onto said item of mail a mark indicative of said rate information computed by said application program, wherein said slot is located along a surface of a housing of said personal computer, said slot defining a transport path which extends in a direction parallel to said surface.

7. A method for printing postage on an item of mail, comprising:

obtaining a personal computer having a housing which includes a printer and a slot formed along a surface of said housing at a postion adjacent said printer, weighing an item of mail on an electronic scale to generate weight information indicative of a weight of said item of mail;

computing postage or private carrier rate information based on said weight information indicative of a weight of said item of mail;

inserting said item of mail into said slot; and printing a mark indicative of said postage or private carrier rate information on said item of mail.

8. A method for printing postage on an item of mail, comprising:

obtaining a personal computer having a housing which includes a printer and a slot formed along a surface of said housing at a postion adjacent said printer, computing postage or private carrier rate information based on weight information indicative of a weight of said item of mail;

inserting said item of mail into said slot; and printing a mark indicative of said postage or private carrier rate information on said item of mail, wherein said slot defines a transport path which extends in a direction parallel to the surface of said housing into which said slot is formed.

9. The method of claim 8, wherein said inserting step includes:

sliding the item of mail by hand through the transport path formed by said slot.

10. The method of claim 8, further comprising:

automatically moving the item of mail through the transport path;

detecting when the item of mail has reached a printing position within said slot; and printing said mark.

11. The method of claim 8, further comprising:

sensing when the item of mail has reached a printing position within said transport path; and printing said mark on the item of mail based on said sensing step.

12. The method of claim 8, further comprising:

forming a stop in said transport path for orienting the item of mail at a printing position when the item of mail is inserted into said transport path.

13. The method of claim 7, wherein said computing step is performed by an application program running on said personal computer, said application program computing said postage or private carrier rate based on said weight of the item of mail.

14. The method of claim 7, wherein said electronic scale is a removable scale cartridge inserted into said personal computer.

15. The method of claim 7, wherein said printing step includes printing said mark at a position on said item of mail that is delimited by a depth of said slot.

16. A system for printing information on an item of mail, comprising:

a portable personal computer having a processing unit which runs an application program for either computing postage and/or private carrier rate information or generating address information, advertising information, or class-of-mail information;

a slot located along a surface of said housing of said personal computer, said slot defining a transport path which extends in a direction parallel to said surface; and a printer included within said housing at a location adjacent said slot, said printer printing one of said rate information, said address information, said advertising information, said class-of-mail information on said item of mail inserted into said slot.

17. The system of claim 16, wherein said slot has a depth which defines a maximum printing range of said printer relative to a print medium inserted into said slot.

18. The system of claim 16, further comprising:

a scale for weighing an item of mail.

19. The system of claim 18, wherein said scale is a removable scale cartridge adapted for insertion into said slot and for conveying weight signals to the application program in said personal computer to be used in computing said rate information.

20. A method for printing information on an item of mail, comprising:

obtaining a personal computer having a housing which includes a printer and a slot formed along a surface of said housing at a postion adjacent said printer, computing postage or private carrier rate information based on weight information indicative of a weight of said item of mail;

inserting said item of mail into said slot; and printing a mark indicative of said postage or private carrier rate information on said item of mail, wherein said slot defines a transport path which extends in a direction parallel to the surface of said housing into which said slot is formed.

* * * * *